US005543272A

United States Patent [19]

Kojima et al.

[11] Patent Number: 5,543,272

[45] Date of Patent: Aug. 6, 1996

[54] PHOTOGRAPHIC COMPOSITION HAVING FIXING CAPACITY AND A METHOD FOR PROCESSING USING THE SAME

[75] Inventors: Tetsuro Kojima; Masaru Yoshikawa; Yoshihiro Fujita, all of Minami-ashigara, Japan

[73] Assignee: Fuji Photo Film Co., Ltd., Kanagawa, Japan

[21] Appl. No.: 194,509

[22] Filed: Feb. 10, 1994

[30] Foreign Application Priority Data

Feb. 17, 1993 [JP] Japan ..... 5-028104

[51] Int. Cl.[6] ..... G03C 5/38

[52] U.S. Cl. ..... 430/455; 430/393; 430/456; 430/458; 430/459; 430/460

[58] Field of Search ..... 562/29; 430/455, 430/456, 458, 459, 460, 393

[56] References Cited

U.S. PATENT DOCUMENTS 4,508,733 4/1985 Moreuil ..... 562/29
5,120,635 6/1992 Sasaki et al. ..... 430/460

FOREIGN PATENT DOCUMENTS 660856 4/1963 Canada ..... 562/29
393477 10/1990 European Pat. Off. .
405237 1/1991 European Pat. Off. .
42665 3/1982 Japan ..... 562/29
81365 4/1987 Japan ..... 562/29

*Primary Examiner*—Hoa V. Le
*Attorney, Agent, or Firm*—Birch, Stewart, Kolasch & Birch, LLP

[57] ABSTRACT

There is disclosed a photographic composition having fixing capacity and a method for processing a silver halide photographic material using the same. The photographic composition having fixing capacity comprises a photographic composition having fixing capacity, which comprises at least one compound represented by the following formula (I) and at least one compound represented by the following formula (II):

$RSO_2SM$ formula (I)

wherein R represents an aliphatic group, an aromatic group, or a heterocyclic group, and M represents a hydrogen atom or a cationic group, $R^1SO_2M^1$ formula (II)

wherein $R^1$ represents an aliphatic group, an aromatic group, or a heterocyclic group, and $M^1$ represents a hydrogen atom or a cationic group.

16 Claims, No Drawings

PHOTOGRAPHIC COMPOSITION HAVING FIXING CAPACITY AND A METHOD FOR PROCESSING USING THE SAME

FIELD OF THE INVENTION

The present invention relates to a photographic composition having fixing capacity and a method for processing a silver halide photographic material using the same. More particularly, the inventive method relates to a method for processing a silver halide photographic material wherein even when low-replenishing-rate processing is carried out, the fixing is not delayed.

BACKGROUND OF THE INVENTION

The processing of silver halide color photographic materials generally comprises a color-developing process and a desilvering process. The silver produced in the development is oxidized with a bleaching agent and then dissolved by the action of a fixing agent. As the bleaching agent, a ferric (III) ion complex salt (e.g., an aminopolycarboxylic acid/ferric (III) complex salt) is normally used, and as the fixing agent a thiosulfate is generally used.

On the other hand, the processing of black-and-white photographic materials comprises a developing process and a process for removing the unexposed silver halide, and it differs from the processing of color photographic materials in that the black-and-white photographic material is subjected to the fixing process without being subjected to a bleaching process after the development. Also in this case, as the fixing agent, generally a thiosulfate is used.

In recent years, reduction of the replenisher volume of photographic processing solutions has been vigorously studied. This is also true for the bath having fixing capacity. As low-replenishing-rate processing proceeds, the amount of silver ions and halide ions (e.g., iodide ions, bromide ions, and chloride ions) that accumulate in the running exhausted solution increase, resulting in slowing of fixing, which is a serious problem, and therefore a solution composition is desired with which, even when low-replenishing-rate processing is effected, the fixing is not delayed.

Further, the stability of solutions becomes a problem because of the elongation of retention time at the low-replenishment-rate processing. In particular, thiosulfates that are used widely as fixing agents have a problem of sulfur-deposit. An improvement of this problem is highly desired.

To improve the above-described problem, conventionally thiocyanate ions (e.g., ammonium thiocyanate and sodium thiocyanate) are added into a fixing solution, but the delay in the fixing is not satisfactorily improved and there is concern about the influence of thiocyanate ions on the environment, and therefore more effective materials are desired.

SUMMARY OF THE INVENTION

Therefore, the first object of the present invention is to provide a method for processing a silver halide photographic material wherein, even when low-replenishing-rate processing is carried out, the fixing is not delayed.

The second object of the present invention is to provide a method for processing a silver halide photographic material wherein, even when low-replenishing-rate processing is carried out, precipitates do not occur.

The above and other objects, features, and advantages of the invention will be apparent more fully from the following description.

DETAILED DESCRIPTION OF THE INVENTION

The above object has been achieved by the following photographic composition having fixing capacity and a method for processing a silver halide photographic material using the same:

(1) A photographic composition having fixing capacity, which comprises at least one compound represented by the following formula (I):

$$RSO_2SM \qquad \text{formula (I)}$$

wherein R represents an aliphatic group, an aromatic group, or a heterocyclic group, and M represents a hydrogen atom or a cationic group.

(2) A method for processing a silver halide photographic material wherein, after a silver halide photographic material having at least one photosensitive silver halide emulsion layer on a support is exposed to light, the silver halide photographic material is subjected to development processing, which comprises processing in a bath having fixing capacity which contains at least one compound represented by the formula (I) as stated in the above (1).

(3) The method for processing a silver halide photographic material as stated in the above (2), wherein the bath having fixing capacity contains at least one compound represented by the above formula (I) in an amount of 0.01 mol/liter or more.

(4) The method for processing a silver halide photographic material as stated in the above (2), wherein the bath having fixing capacity contains thiosulfate ions and further at least one compound represented by the above formula (I).

(5) The method for processing a silver halide photographic material as stated in the above (2), wherein the bath having fixing capacity contains thiosulfate ions in an amount of 0.1 mol/liter or more and at least one compound represented by the above formula (I) in an amount of 0.01 mol/liter or more.

(6) A method for processing a silver halide photographic material wherein, after a silver halide photographic material having at least one photosensitive silver halide emulsion layer on a support is exposed to light, the silver halide photographic material is subjected to development processing, which comprises processing in a bath having fixing capacity which contains at least one compound represented by the formula (I) as stated in the above (1), and then processing in an washing bath and/or a stabilizing bath.

(7) A photographic composition having fixing capacity, which comprises at least one compound represented by the following formula (I) and at least one compound represented by the following formula (II):

$$RSO_2SM \qquad \text{formula (I)}$$

wherein R represents an aliphatic group, an aromatic group, or a heterocyclic group, and M represents a hydrogen atom or a cationic group, $$R^1SO\ M^1 \qquad \text{formula (II)}$$

wherein $R^1$ represents an aliphatic group, an aromatic group, or a heterocyclic group, and $M^1$ represents a hydrogen atom or a cationic group.

(8) A method for processing a silver halide photographic material wherein, after a silver halide photographic material having at least one photosensitive silver halide emulsion layer on a support is exposed to light, the silver halide photographic material is subject to development processing, which comprises processing in a bath having fixing capacity which contains at least one compound represented by the formula (I) and at least one compound represented by the formula (II), as stated in the above (7).

(9) The method for processing a silver halide photographic material as stated in the above (8), wherein the bath having fixing capacity contains thiosulfate ions and further at least one compound represented by the formula (I) and at least one compound represented by the formula (II), as stated in the above (7).

(10) A method for preparing a photographic replenisher having fixing capacity, which comprises, at preparing the replenisher having fixing capacity, adding at least one compound represented by the formula (I) and at least one compound represented by the formula (II), as stated in the above (7), separately and/or adding a solution in which both of the above compounds coexist.

(11) The method for processing a silver halide photographic material as stated in above (8), wherein the bath having fixing capacity contains at least one compound represented by the formula (I), as stated in the above (7), in an amount of 0.01 mol per liter or more, and at least one compound represented by the formula (II), as stated in the above (7), in an amount of 0.01 mol per liter or more.

(12) The method for processing a silver halide photographic material as stated in above (8), wherein the bath having fixing capacity contains thiosulfate ions in an amount of 0.1 mol per liter or more and further at least one compound represented by the formula (I), as stated in the above (7), in an amount of 0.01 mol per liter or more, and at least one compound represented by the formula (II), as stated in the above (7), in an amount of 0.01 mol per liter or more.

(13) A method for processing a silver halide photographic material, wherein after a silver halide photographic material having a silver halide emulsion layer on a support is exposed to light, the silver halide photographic material is subjected to development processing, which comprises processing in a bath having fixing capacity which contains at least one compound represented by the formula (I) and at least one compound represented by the formula (II), as stated in the above (7) and, after the processing using the bath having fixing capacity, processing in an washing bath and/or a stabilizing bath.

Formulae (I) and (II) of the present invention will now be described in detail below.

In formulae (I) and (II), the aliphatic group represented by R or $R^1$ is preferably one having 1 to 30 carbon atoms and is particularly a straight-chain, branched-chain, or cyclic alkyl group, alkenyl group, alkynyl group, or aralkyl group having 1 to 20 carbon atoms. As examples of the alkyl group, the alkenyl group, the alkynyl group, and the aralkyl group can be mentioned, for example, methyl, ethyl,isopropyl, t-butyl, n-octyl, n-decyl, n-hexadecyl, cyclopropyl, cyclopentyl, cyclohexyl, allyl, 2-butenyl, 3-pentenyl, propargyl, 3-pentynyl, and benzyl.

The aromatic group represented by R or $R^1$ in formulae (I) and (II) is preferably one having 6 to 30 carbon atoms and is preferably particularly an aryl group having 6 to 20 carbon atoms, which may be a monocyclic ring or a fused ring, such as a phenyl group and naphthyl group.

The heterocyclic group represented by R or $R^1$ in formulae (I) and (II) is a 3- to 10-membered saturated or unsaturated heterocyclic group having at least one of a nitrogen atom, an oxygen atom, and a sulfur atom, which may be monocyclic or may be fused to other aromatic ring to form a fused ring. The heterocyclic group is preferably a 5- to 6-membered aromatic heterocyclic ring and as examples can be mentioned, for example, pyridyl, imidazolyl, quinolyl, benzimidazolyl, pyrimidyl, pyrazolyl, isoquinolinyl, thiazolyl, thienyl, furyl, and benzothiazolyl.

The groups represented by R and $R^1$ in formulae (I) and (II) may be substituted. Examples of the substituent are the following: a halogen atom (e.g., fluorine, chlorine, and bromine), an alkyl group (e.g., methyl, ethyl, n-propyl, isopropyl, t-butyl, n-octyl, cyclopentyl, and cyclohexyl), an alkenyl group (e.g., ally, 2-butenyl, and 3-pentenyl), an alkynyl group (e.g., a propargyl and 3-pentynyl), an aralkyl group (e.g., benzyl and phenetyl), an aryl group (e.g., phenyl, naphthyl, and 4-methylphenyl), a heterocyclic group (e.g., pyridyl, furyl, imidazolyl, piperidyl, and morpholino), an alkoxy group (e.g., methoxy, ethoxy, and butoxy), an aryloxy group (e.g., phenoxy and 2-naphthyloxy), an amino group (e.g., unsubstituted amino, dimethylamino, ethylamino, and anilino), an acylamino group (e.g., acetylamino and benzoylamino), a ureido group (e.g., unsubstituted ureido, N-methylureido, and N-phenylureido), a urethane group (e.g., methoxycarbonylamino and phenoxycarbonylamino), a sulfonylamino group (e.g., methylsulfonylamino and phenylsulfonylamino), a sulfamoyl group (e.g., unsubstituted sulfamoyl, N,N-dimethylsulfamoyl, and N-phenylsulfamoyl), a carbamoyl group (e.g., unsubstituted carbamoyl, N,N-diethylcarbamoyl, and N-phenylcarbamoyl), a sulfonyl group (e.g., mesyl and tosyl), a sulfinyl group (e.g., methylsulfinyl and phenylsulfinyl), an alkyloxycarbonyl group (e.g., methoxycarbonyl and ethoxycarbonyl), an aryloxycarbonyl group (e.g., phenoxycarbonyl), an acyl group (e.g., acetyl, benzoyl, formyl, and pivaolyl), an acyloxy group (e.g., acetoxy and benzoyloxy), a phosphoric acid amido group (e.g., N,N-diethylphosphoric acid amide), an alkylthio group (e.g., methylthio and ethylthio), an arylthio group (e.g., phenylthio), a cyano group, a sulfo group, a thiosulfon group, a carboxyl group, a hydroxyl group, a mercapto group, a phosphono group, a nitro group, a sulfino group, an ammonio group (e.g., trimethylammonio), a phosphonio group, and a hydrazino group, which may be substituted. If there are two or more substituents, they may be the same or different.

The cation group represented by M or $M^1$ in formulae (I) and (II) includes, for example, an alkali metal ion (e.g., a sodium ion, a potassium ion, lithium ion, and a cesium ion), an alkali earth metal ion (e.g., a calcium ion and a magnesium ion), an ammonium group (e.g., unsubstituted ammonium, methylammonium, trimethylammonium, tetramethylammonium, and dimethylbenzylammonium), and a guanidinium group.

In formula (I), preferably, R represents an aliphatic group, an aromatic group, or a heterocyclic group, and M represents a hydrogen atom, an alkali metal ion, or an ammonium group.

In formula (I), more preferably, R represents an aliphatic group having 1 to 6 carbon atoms, and M represents a sodium ion, a potassium ion, or an unsubstituted ammonium group.

In formula (I), most preferably R represents an alkyl group having 1 to 6 carbon atoms, and M represents a sodium ion, a potassium ion, or an unsubstituted ammonium group.

In formula (II) preferably, $R^1$ represents an aliphatic group or an aromatic group, and $M^1$ represents a hydrogen atom, an alkali metal ion, or an ammonium group.

In formula (II), more preferably, $R^1$ represents an aliphatic group having 1 to 6 carbon atoms or an aromatic group having 6 to 12 carbon atoms, and $M^1$ represents a sodium ion, a potassium ion, or an unsubstituted ammonium group.

In formula (II), most preferably $R^1$ represents an alkyl group having 1 to 6 carbon atoms or an aromatic group substituted by at least one of carboxyl group, sulfo group, hydroxyl group, and amino group, and $M^1$ represents a sodium ion, a potassium ion, or an unsubstituted ammonium group.

Specific examples of the compounds represented by formulae (I) and (II) of the present invention are shown below, but the present invention is not limited to them.

$CH_3SO_2SNH_4$ I-1.

$CH_3SO_2SNa$ I-2.

$CH_2SO_2SK$ I-3.

$C_2H_5SO_2SNH_4$ I-4.

$C_2H_5SO_2SNa$ I-5.

$H_2NCH_2CH_2SO_2SNH_4$ I-6.

$H_2NCH_2CH_2SO_2SNa$ I-7.

$\overset{+}{H_3}NCH_2CH_2SO_2S^-$ I-8.

$HOCH_2CH_2SO_2SNa$ I-9.

$HOCH_2CH_2SO_2SNH_4$ I-10.

$HOOCCH_2CH_2SO_2SNa$ I-11.

$H_2NOOCCH_2CH_2SO_2SNH_4$ I-12.

$F_3CSO_2SNH_4$ I-13.

$NaSSO_2CH_2CH_2SO_2SNa$ I-14.

$H_2N\overset{NH}{\overset{\|}{C}}NHCH_2CH_2SO_2SH$ I-15.

$CH_3\overset{OH}{\overset{|}{C}}HSO_2SK$ I-16.

$CH_3\overset{OH}{\overset{|}{C}}HSO_2SNH_4$ I-17.

$HOOC-\overset{NH_2}{\overset{|}{C}}HCH_2SO_2SNa$ I-18.

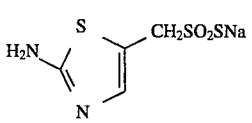

I-19.

$CH_3SO_2SLi$ I-20.

$HOOC\overset{NH_2}{\overset{|}{C}}HCH_2SO_2SNH_4$ I-21.

$CH_3SO_2S^-\overset{+}{N}(CH_3)_4$ I-22.

-continued $CH_3-\overset{CH_3}{\overset{|}{\underset{CH_3}{\underset{|}{N^+}}}}CH_2CH_2SO_2S^-$ I-23.

$H_2N\overset{NH_2}{\overset{|}{C}}H_2CH_2CHCH_2SO_2SH$ I-24.

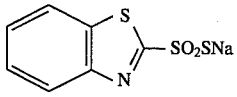

I-25.

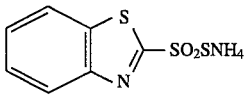

I-26.

$C_3H_7SO_2SNH_4$ I-27.

$C_3H_7SO_2SNa$ I-28.

$C_4H_9SO_2SNH_4$ I-29.

$C_6H_{13}SO_2SNa$ I-30.

$CH_3CONHCH_3SO_2SNH_4$ I-31.

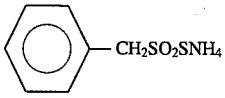

I-32.

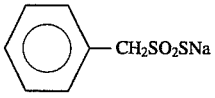

I-33.

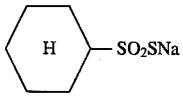

I-34.

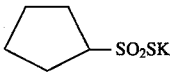

I-35.

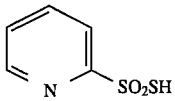

I-36.

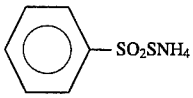

I-37.

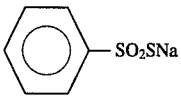

I-38.

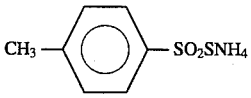

I-39.

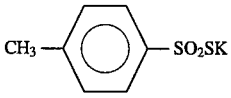

I-40.

$CH_3\overset{CH_3}{\overset{|}{C}}HCH_2SO_2SNa$ I-41.

-continued

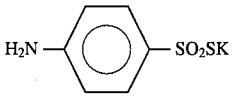

I-42.

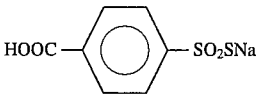

I-43.

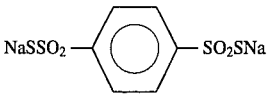

I-44.

$CH_2{=}CHCH_2SO_2SNa$ I-45.

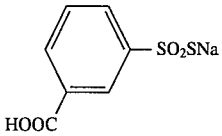

I-46.

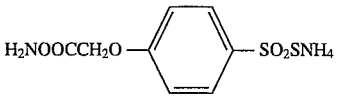

I-47.

$CH_3SO_2NH_4$ II-1.

$CH_3SO_2Na$ II-2.

$CH_2SO_2K$ II-3.

$C_2H_5SO_2NH_4$ II-4.

$C_2H_5SO_2Na$ II-5.

$H_2NCH_2CH_2SO_2NH_4$ II-6.

$H_2NCH_2CH_2SO_2Na$ II-7.

$\overset{+}{H_3}NCH_2CH_2SO_2^-$ II-8.

$HOCH_2CH_2SO_2Na$ II-9.

$HOCH_2CH_2SO_2NH_4$ II-10.

$HOOCCH_2CH_2SO_2Na$ II-11.

$H_2NOOCCH_2CH_2SO_2NH_4$ II-12.

$F_3CSO_2NH_4$ II-13.

$NaSO_2CH_2CH_2SO_2Na$ II-14.

$H_2N\overset{\overset{NH}{\|}}{C}NHCH_2CH_2SO_2H$ II-15.

$CH_3\overset{\overset{OH}{|}}{C}HSO_2K$ II-16.

$CH_3\overset{\overset{OH}{|}}{C}HSO_2NH_4$ II-17.

$HOOC{-}\overset{\overset{NH_2}{|}}{C}HCH_2SO_2Na$ II-18.

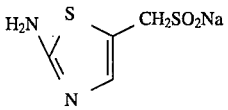

II-19.

-continued $CH_3SO_2Li$ II-20.

$HOOC\overset{\overset{NH_2}{|}}{C}HCH_2SO_2NH_4$ II-21.

$CH_3SO_2^-N^+(CH_3)_4$ II-22.

$CH_3{-}\overset{\overset{CH_3}{|}}{\underset{\underset{CH_3}{|}}{N^+}}CH_2CH_2SO_2^-$ II-23.

$H_2N\overset{\overset{NH_2}{|}}{C}H_2CH_2CHCH_2SO_2H$ II-24.

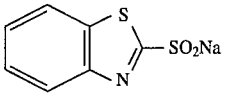

II-25.

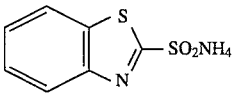

II-26.

$C_3H_7SO_2NH_4$ II-27.

$C_3H_7SO_2Na$ II-28.

$C_4H_9SO_2NH_4$ II-29.

$C_6H_{13}SO_2Na$ II-30.

$CH_3CONHCH_2SO_2NH_4$ II-31.

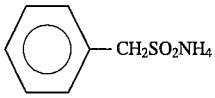

II-32.

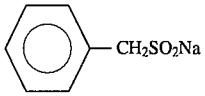

II-33.

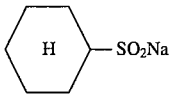

II-34.

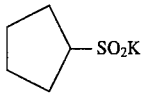

II-35.

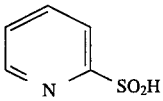

II-36.

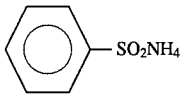

II-37.

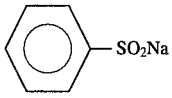

II-38.

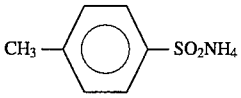

II-39.

-continued

II-40. 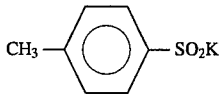

II-41. $CH_3CH(CH_3)CH_2SO_2Na$

II-42. 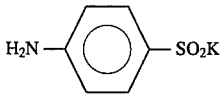

II-43. 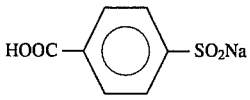

II-44. 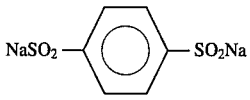

II-45. $CH_2=CHCH_2SO_2Na$

II-46. 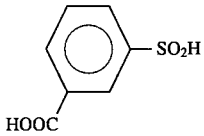

II-47. 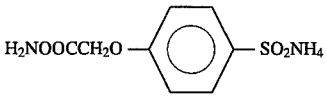

II-48. 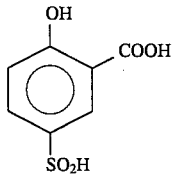

II-49. 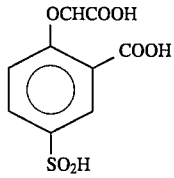

II-50. 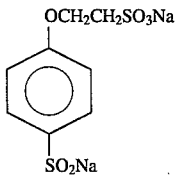

The compound represented by formula (I) can be synthesized by reaction of a sulfonyl chloride compound with a sulfide, such as an alkali metal sulfide or ammonium sulfide, or reaction of a sulfinic acid compound with elemental sulfur, which synthesis method has long been known. For example, for the synthesis of the compound, reference can be made to *J. Anal. Chem. USSR.*, Vol. 20, 1701 (1950) and German Patent No. 840,693 (1952).

The compound represented by formula (II) can be synthesized, generally, by reduction of sulfonyl chloride, and as a reducing reagent can be used zinc dust, sulfite ion, or alkali metal sulfide. Further some other methods are known. Further, the compound of formula (II) can be utilized as a synthesis intermediate of the compound of formula (I). As a common synthesis method can be mentioned, for example, those described in *Chem. Rev.*, 48, 69 (1951), *Organic Synthesis*, Collective Vol. I, 492 (1941), *J. Am. Chem. Soc.*, 72, 1215 (1950), and ibid. 50, 792,274 (1928).

As "a bath having fixing capacity" in the present invention, can be mentioned, for example, a fixing bath or a bleach-fix bath, and various combinations are possible in accordance with the processing process. As a photographic composition having fixing capacity in the present invention can be mentioned, for example, one for use in the fixing bath such as a fixing solution or one for use in the bleach-fix bath such as a bleach-fix solution. Although the compounds represented by formula (I) and (II) of the present invention can be used only in combination thereof, when the compounds are used in combination with a usual fixing agent, their performances can be exhibited remarkably.

Amounts of compounds represented by formula (I) and (II) of the present invention for use in fixing bath or bleach-fix bath are preferably $1\times10^{-3}$ to 5 mol, more preferably $1\times10^{-2}$ to 3 mol, and particularly preferably $1\times10^{-1}$ to 2 mol, per liter of the fixing solution or bleach-fix solution.

The presence ratio of compound represented by formula (I) and compound represented by formula (II) can be determined arbitrarily, and the ratio is preferably 1:9 to 9:1, more preferably 2:8 to 8:2.

Addition of compounds represented by formulae (I) and (II) into the water-washing bath or stabilizing bath and also to allow to carry over them from the preceding bath are effective to prevent the occurrence of precipitate in the water-washing bath and stabilizing bath. Herein, the concentration of them in these baths is preferably $10^{-3}$ to 0.5 times the concentration of them in the preceding bath.

The compounds represented by formulae (I) and (II) of the present invention may be used in combination with other fixing agents. As a fixing agent that can be used additionally, a thiosulfate, such as sodium thiosulfate, ammonium thiosulfate, ammonium sodium thiosulfate and potassium thiosulfate; a thiocyanate (rhodanate), such as ammonium thiocyanate and potassium thiocyanate; a thiourea compound; a thioether compound; a mercapto compound; and a methoionic compound can be mentioned, with preference given to a thiosulfate. Preferably the amount of the thiosulfate to be added is 0.1 to 3 mol, more preferably 0.5 to 1.5 mol, per liter of the fixing solution.

When the compounds represented by formulae (I) and (II) of the present invention are used in combination with a thiosulfate, preferably the amount of the compound of the present invention to be added is 0.01 to 3 mol, more preferably 0.05 to 2 mol, and most preferably 0.1 to 1 mol, per liter of the fixing solution. If the amount to be added is too small, the fixing-facilitating effect becomes small, while if the amount is too large, deposition is liable to occur during the storage of the fixing solution at a low temperature.

When the compounds represented by formulae (I) and (II) of the present invention are used in combination with a thiosulfate, particularly when low-replenishing-rate processing is carried out, the improvement in the fixing performance is conspicuous, even if silver ions and halide ions (particularly iodide ions) accumulate.

If the additionally used fixing agent is sodium thiosulfate, M in formula (I) and $M^1$ in formula (II) are preferably a sodium ion and, on the other hand, if the additionally used fixing agent is ammonium thiosulfate, M in the formula (I) and $M^1$ in formulae (II) are preferably an unsubstituted ammonium group.

When compounds represented by formulae (I) and (II) are added into the bath having fixing capacity, compounds of formula (I) and (II) may be added separately or added in a form previously mixed solution.

Since the compound of formula (I) can be synthesized by using the compound of formula (II) as a raw material, as described before, possibly a mixed solution of compounds of formulae (I) and (II) synthesized in a synthesis processes of compounds can be added when R and $R^1$ and M and $M^1$ are the same.

The composition having fixing capacity of the present invention may be supplied in the form of solution or in the form of powder. When it is supplied in the form of solution, it may be a use solution or a condensed solution. In the present invention, the total content of the compounds represented by formulae (I) and (II) contained in the composition is preferably 5 to 100 wt. % for the powder composition, and 0.1 to 10 mol per liter for the condensed solution composition.

Now, processing solutions that can be used preferably mainly for the processing of color photographic materials are described.

The photographic emulsion layer after color-developed is generally subjected to a bleaching process. The bleaching process may be carried out at the same time as a fixing process (bleach-fix process) or separately. Further, to intend the rapidness of processing, a processing process can be effected wherein the bleach-fix is carried out after bleaching process. Further, processing in two continuous bleach-fix baths, fixing process before bleach-fix processing, or bleaching processing after bleach-fix process may be carried out arbitrarily depending on the purpose.

As the bleaching agent to be contained as a major component of the bleaching solution or the bleach-fix solution of the present invention, can be mentioned inorganic compounds, such as red prussiate, ferric chloride, chromates, persulfates, and bromates and partially organic compounds, such as aminopolycarboxylic acid ferric complex salts and aminopolyphosphoric acid ferric complex salts.

In the present-invention, in view, for example, of the environmental protection, the handling safety, and corrosion of metals, aminopolycarboxylic acid ferric complex salts are preferably used.

Specific examples of aminopolycarboxylic acid ferric complex salts are given below, but the present invention is not restricted to them. The oxidation-reduction potentials are also given additionally.

| No. | Compound | Oxidation-reduction potential (mV vs. NHE, pH = 6) |
|---|---|---|
| 1. | N-(2-acetamide)iminodiacetic acid ferric complex salt | 180 |
| 2. | methyliminodiacetic acid ferric complex salt | 200 |
| 3. | iminodiacetic acid ferric complex salt | 210 |
| 4. | 1,4-butylenediaminetetraacetic acid ferric complex salt | 230 |
| 5. | diethylene thioether diaminetetraacetic acid ferric complex salt | 230 |
| 6. | glycol ether diaminetetraacetic acid ferric complex salt | 240 |
| 7. | 1,3-propylenediaminetetraacetic acid ferric complex salt | 250 |
| 8. | ethylenediaminetetraacetic acid ferric complex salt | 110 |
| 9. | diethylenetriaminepentaacetic acid ferric complex salt | 80 |
| 10. | trans-1,2-cyclohexadiaminetetra-acetic acid ferric complex salt | 80 |

The oxidation-reduction potentials of the above bleaching agents are defined as those measured by the method described in *Transaction of the Faraday Society*, Vol. 55 (1959), pp 1312 to 1313.

In the present invention, in view of the rapid processing and with a view to allowing the effect of the present invention to being exhibited effectively, it is preferable to use a bleaching agent having an oxidation-reduction potential of 150 mV or over, more preferably 180 mV or over, and most preferably 200 mV or over. If the oxidation-reduction potential is too high, since bleach fogging will occur, the upper limit is 700 mV or below, preferably 500 mV or below.

Among these, Compound No. 7, that is, 1,3-propylenediaminetetraacetic acid ferric complex salt, is particularly preferable.

The aminopolycarboxylic acid ferric complex salt is used, for example, in the form of sodium salt, potassium salt, or ammonium salt, and the ammonium salt is preferable because the bleaching speed is highest.

The amount of the bleaching agent to be used in the bleaching solution is preferably 0.17 to 0.7 mol per liter of the bleaching solution, and with a view to making the processing rapid and with a view to reducing stain that will be formed with time preferably the amount of the bleaching agent to be used in the bleaching solution is 0.25 to 0.7 mol, particularly preferably 0.30 to 0.6 mol, per liter of the bleaching solution. The amount of the bleaching agent to be used in the bleach-fix solution is 0.01 to 0.5 mol, preferably 0.02 to 0.2 mol, per liter of the bleach-fix solution.

Further in the present invention, the oxidizing agents may be used alone or as a mixture of two or more, and if two or more oxidizing agents are used in combination, it is suggested that the combined concentration falls within the above concentration.

Incidentally, if an aminopolycarboxylic acid ferric salt is used in the bleaching solution or the bleach-fix solution, although it can be used in the form of the above complex salt, a complex salt may be formed in the processing solution by allowing an aminopolycarboxylic acid that will form a complex forming compound to be present with a ferric salt (e.g., ferric sulfate, ferric chloride, ferric nitrate, ammonium ferric sulfate, and ferric phosphate).

In this case wherein a complex is formed, the aminopolycarboxylic acid may be added in slightly excess over the required amount for the formation of the complex with the ferric ions, and when it is added in excess, generally it is added in an amount of 0.01 to 10% excess.

Generally, the above bleaching solution is used at a pH of 2 to 7.0. With a view of making the processing rapid, preferably the bleaching solution is used at a pH of 2.5 to 5.0, more preferably 3.0 to 4.8, and particularly preferably 3.5 to 4.5, and preferably the replenisher is used at a pH of 2.0 to 4.2.

In the present invention, in order to adjust the pH to the above range, it is possible to use a known acid.

Preferably such an acid is an acid having a pKa of 2 to 5.5. In the present invention, pKa indicates the logarithmic value of the reciprocal of the acid dissociation constant and is the value obtained at an ion strength of 0.1 mol/dm and at 25° C.

It is preferable that an acid having a pKa of 2.0 to 5.5 is contained in the bleaching solution in an amount of 0.5 mol/liter or more because bleach fogging can be prevented and precipitation from the replenisher with time can be prevented.

The acid having a pKa of 2.0 to 5.5 may be any of inorganic acids, such as phosphoric acid, and organic acids, such as acetic acid, malonic acid, and citric acid, with particular preference given to an organic acid having a carboxylic group(s).

The organic acid having a pKa of 2.0 to 5.5 may be a monobasic acid or polybasic acid. In the case of a polybasic acid, it can be used in the form of a metal salt (e.g., a sodium salt or a potassium salt) or an ammonium salt if its pKa is in the above range of 2.0 to 5.5. Further, organic acids having a pKa of 2.0 to 5.5 may be used as a mixture of two or more.

Preferable specific examples of organic acids having a pKa of 2.0 to 5.5 that can be used in the present invention are an aliphatic monobasic acid, such as acetic acid, monochloroacetic acid, glycolic acid, propionic acid, lactic acid, glycolic acid, acrylic acid, butyric acid, isobutyric acid, pivalic acid, and aminobutyric acid; an amino acid compound, such as asparagine, alanine, arginine, ethionine, glycine, glutamine, cysteine, serine, methionine, and leucine; an aromatic monobasic acid, such as benzoic acid, monosubstituted benzoic acid, for example, chlorobenzoic acid, and hydroxybenzoic acid, and nicotinic acid; an aliphatic dibasic acid, such as oxalic acid, malonic acid, succinic acid, tartaric acid, malic acid, maleic acid, fumaric acid, oxaloacetic acid, glutaric acid, and adipic acid; an amino acid-series dibasic acid, such as asparagic acid, glutamic acid, and cystine; an aromatic dibasic acid, such as phthalic acid and terephthalic acid; and a polybasic acid, such as citric acid.

Among these, dibasic acids having carboxyl groups is preferred, with particular preference given to succinic acid, maleic acid, and glutaric acid.

The amount of these organic acids to be used is 0.2 to 2 mol, preferably 0.4 to 1.0 mol, per liter of the bleaching solution. These acids are preferable because they allow the effect of the present invention to be exhibited more noticeably, are free of any smell, and inhibit bleach fogging.

The total amount of these acids to be used is suitably 0.3 mol or more, preferably 0.4 to 2.0 mol, and more preferably 0.5 to 1.0 mol, per liter of the bleaching solution.

When the pH of the bleaching solution is adjusted to the above range, the above acid can be used in combination with an alkaline chemical (e.g., aqueous ammonia, KOH, NaOH, imidazole, monoethanolamine, and diethanolamine). Particularly preferably the acid may be used in combination with aqueous ammonia.

As an alkaline chemical to be used for a bleach starter when the start solution of the bleaching solution is adjusted from the replenisher, potassium carbonate, aqueous ammonia, imidazole, monoethanolamine, and diethanolamine are preferably used. Without using a bleach starter, the replenisher may be diluted to be used.

To the bleaching solution, bleach-fix solution or its preceding bath for use in the present invention, various bleaching accelerators can be added. For such bleaching accelerators, for example, compounds having a mercapto group or a disulfide group described in U.S. Pat. No. 3,893,858, German Patent No. 1,290,821, British Patent No. 1,138,842, JP-A No. 95630/1978, and *Research Disclosure* No. 17129 (July, 1978), thiazolidine derivatives described in JP-A No. 140129/1975, thiourea derivatives described in U.S. Pat. No. 3,706,561, iodides described in JP-A No. 16235/1983, polyethylene oxides described in German Patent No. 2,748,430, and polyamine compounds described in JP-B No. 8836/1970 can be used. Particularly preferably, mercapto compounds as described in British Patent No. 1,138,842 and JP-A No. 11256/1989 are preferred.

In the bleaching solution or bleach-fix solution for use in the present invention, in addition to the bleaching agent and the above compounds, a rehalogenizing agent, e.g., a bromide, such as potassium bromide, sodium bromide, and ammonium bromide; and a chloride, such as potassium chloride, sodium chloride, and ammonium chloride can be contained. The concentration of the rehalogenizing agent is 0.1 to 5.0 mol, preferably 0.5 to 3.0 mol, per liter of the processing solution.

Further, it is preferable to use ammonium nitrate as a metal corrosion inhibitor.

In the present invention, preferably a replenishing system is used, and the replenishment rate of the bleaching solution or bleach-fix solution is preferably 600 ml or less, more preferably 100 to 500 ml, per $m^2$ of the photographic material.

The processing time of bleaching or bleach-fix is 120 sec or less, preferably 50 sec or less, and more preferably 40 sec or less.

In the processing, preferably the bleaching solution wherein an aminopolycarboxylic acid ferric complex salt is used is aerated to oxidize the produced aminopolycarboxylic acid ferric (II) complex salt. Thus, the oxidizing agent is regenerated and the photographic properties can be kept quite stably.

For the processing solutions for use in respective processes in the present invention, preferably water is supplied to compensate the evaporated water to carry out so-called evaporation correction.

As a specified method for replenishing water, although there is no restriction in particular, the method as described in JP-A Nos. 254959/1989 and 254960/1989, wherein the evaporated amount of water is determined from a monitor water bath provided besides the bleaching bath, from which amount the evaporated amount of water in the bleaching bath is calculated, and the corresponding amount of water is replenished, and the evaporation correction method using a water-level sensor and overflow sensor, as described in JP-A Nos. 248155/1991, 249644/1991, 249645/1991, 249646/1991, and 14042/1992, are preferable.

To the solution having fixing capacity, can be added, as a preservative, sulfites (e.g., sodium sulfite, potassium sulfite, and ammonium sulfite), hydroxylamines, hydrazines, bisulfate addition compounds of aldehydes (e.g., acetaldehyde adduct with sodium bisulfate). Further, various brightening agents, anti-foaming agents, or surface-active agents, polyvinyl pyrrolidones, and organic solvents, such as methanol can be added.

For the purpose of stabilizing the processing solutions, preferably, a chelating agent, such as various polyaminocarboxylic acids and organic phosphonic acids, is added to the solution having fixing capacity. As preferable chelating agents, polyaminocarboxylic acids can be mentioned such as nitrilotriacetic acid, hydroxyethylimidinodiacetic acid, nitriloacetic acid dipropionic acid, ethylenediamine-tetraacetic acid, diethylenetriaminepentaacetic acid, cyclohexanediaminetetraacetic acid, 1,2-propylenediamine-tetraacetic acid, ethylenediaminedisuccinic acid, and 1,3-propylenediaminedisuccinic acid. The amount of the chelating agent to be added is 0.01 to 0.3 mol, preferably 0.03 to 0.2 mol, per liter of the processing solution.

Although the bleach-fix solution (start solution) at the time of start of the processing is prepared by dissolving in water the above-mentioned compound that can be used in a bleach-fix solution, the said bleach-fix solution can be prepared by mixing suitable amounts of a bleaching solution and a fixing solution that are separately prepared.

The pH of the fixing solution for color photographic materials is preferably 5 to 9, more preferably 7 to 8. The pH of the bleach-fix solution is preferably 6 to 8.5, more preferably 6.5 to 8.0.

In order to adjust the pH of the fixing solution and the bleach-fix solution to such ranges, as a buffer, a compound having a pKa in the range of 6.0 to 9.0 is preferably contained. Preferably such compounds are imidazoles, such as imidazole and 2-methylimidazole. Such compounds are used in an amount of 0.1 to 10 mol, preferably 0.2 to 3 mol, per liter of the processing solution.

If replenishment processing is carried out, the replenishment rate of the solution having fixing capacity is generally 2,000 ml or less, preferably 100 to 2,000 ml, more preferably 200 to 800 ml, and particularly preferably 300 to 600 ml, per $m^2$ of the photographic material. In this case, the replenishment rate is the replenisher volume containing fixing agent, but if an overflow solution, such as subsequent washing water, is introduced into the bath having fixing capacity, the replenishment rate includes the amount of that overflow solution. The smaller the replenishment rate is, the more remarkable the effect of the present invention becomes.

In addition to the replenishing of the fixing replenisher to the solution having fixing capacity, the washing water or stabilizing solution of the subsequent bath is preferably introduced to the fixing solution. In this case, part or all of the overflow solution of the subsequent processing bath may be introduced to the bath having fixing capacity, or the processing solution in the processing bath may be directly pumped into the bath having fixing capacity.

In the present invention, the total processing time by the solution having fixing capacity is 0.5 to 4 min, preferably 0.5 to 2 min, and particularly preferably 0.5 to 1 min.

In the present invention, the total processing time of the desilvering step, including bleaching, bleach-fix, and fixing is preferably 45 sec to 4 min, more preferably 1 to 2 min. The processing temperature is 25° to 50° C., preferably 35° to 45° C.

From the solution having fixing capacity of the present invention, silver can be recovered in a known manner, and the regenerated solution thus obtained by recovering silver can be reused. As the method for recovering silver, for example, an electrolysis method (described in French Patent No. 2,299,667), precipitation methods (described in JP-A No. 73037/1977 and German Patent No. 2,331,220), ion exchange methods (described in JP-A No. 17114/1976 and German Patent No. 2,548,237), and a metal substitution method (described in British Patent No. 1,353,805) are effective. These silver-recovering methods are preferably carried out from the tank solution in an in-line manner, since the rapid processability is further improved.

After the processing step with the solution having fixing capacity, generally, a washing processing step is carried out. After the processing with the solution having fixing capacity, a simple processing method can be used wherein stabilizing processing that uses a stabilizing solution is carried out without carrying out washing substantially.

In order to prevent the processed photographic material from having water stains at the time of drying, the washing water used in the washing step can contain various surface-active agents. These surface-active agents include polyethylene glycol-type nonionic surface-active agents, polyhydric alcohol-type nonionic surface-active agents, alkylbenzene sulfonate-type anionic surface-active agents, higher-alcohol sulfate-type surface-active agents, alkylnaphthalene sulfonate-type anionic surface-active agents, quaternary ammonium salt-type cationic surface-active agents, amine salt-type cationic surface-active agents, amino salt-type amphoteric surface-active agents, and betaine-type amphoteric surface-active agents, with preference given to nonionic surface-active agents, and more preference given to alkyl phenol ethylene oxide adducts, As the alkyl phenol, octyl phenol, nonyl phenol, dodecyl phenol, and dinonylphenol are preferable and the number of the added ethylene oxide molecules is particularly preferably 8 to 14. Further, it is also preferable to use a silicon type surface-active agent high in defoaming action.

In the washing water, various bacteriaproofing agents and mildewproofing agents can be contained in order to prevent incrustation from forming or to prevent mildew from propagating on the processed photographic material. As examples of the bacteriaproofing agents and the mildewproofing agents, can be mentioned thiazolylbenzoimidazole compounds as disclosed in JP-A Nos. 157244/1982 and 105145/1983, isothiazolone compounds as disclosed in JP-A No. 8542/1982, chlorophenol compounds, typically trichlorophenol, bromophenol compounds, organotin and organozinc compounds, acid amide compounds, diazine and triazine compounds, thiourea compounds, benzotriazole compounds, alkylguanidine compounds, quaternary ammonium compounds, typically benzalkonium chloride, antibiotics, typically penicillin, and general-purpose mildewproofing agents described in *J. Antibact. Antifung. Agents*, Vol. 1, No. 5, pp 207 to 223 (1983), which can be used as a mixture of two or more. Further, various bactericides described in JP-A No. 83820/1973 can also be used.

Among these compounds, particularly isothiazolone compounds are preferable, and further, among them, 1,2-benzisothiazoline-3-one is preferable. The amount of this compound to be added is 10 to 500 mg per liter of washing solution or stabilizing solution.

In the washing water, various chelating agents are contained preferably. As preferable chelating agents, can be mentioned aminopolycarboxylic acids, such as ethylenediaminetetraacetic acid, diethylenetriaminepentaacetic acid, organic phosphonic acids, such as 1-hydroxyethylidene-1,1-diphosphonic acid, ethylenediaminetetraacetic acid, and diethylenetriamine-N,N,N',N'-tetramethylenephosphonic acid, or hydrolyzates of maleic anhydride polymers described in European Patent No. 34172A1.

Preferably the above-mentioned preservative that can be contained in the fixing solution and the bleach-fix solution is contained in the washing water.

The washing step and the stabilizing step are preferably of a multistage counter-current type, and the number of stages is preferably 2 to 4. The replenishment rate is 1 to 50 times, preferably 2 to 30 times, and more preferably 2 to 15 times, the carried-over amount from the preceding bath per unit area.

As the water for use in these washing steps, tap water can be used, but preferably water that has been deionized with ion exchange resins, to bring the Ca and Mg ions to a concentration of 5 mg/liter or less, or water that has been sterilized, for example, with a halogen or an ultraviolet germicidal lamp, is preferably used.

As the water for supplementing the evaporated amount of the processing solutions, tap water can be used, but deionized water or sterilized water that is preferably used in the above washing step is desirable.

The replenishers of the present invention are adjusted to keep the performance constant by supplying, to the processing solutions, compounds, which have been decreased by the processing of the photographic material and due to their deterioration over time in the automatic processor, and by controlling the concentrations of compounds dissolved out from the photographic material by the processing. Therefore, the compounds that will be decreased are made to have concentrations higher than the concentrations in the processing solutions, and the latter compounds are made to have lower concentrations. Further, in the case of compounds whose concentrations are hardly changed by the processing or over time, the compounds are generally contained approximately in the same concentrations as those of the processing solutions.

All of the above compounds that can be added to the washing water can be contained in the stabilizing solution. Particularly preferably the stabilizing solution contains various surface-active agents for preventing the processed photographic material from having water stains at the time of drying, and bacteriaproofing agents, mildewproofing agents, fungicides, and chelating agents for preventing incrustation from forming or for preventing mildew from propergating on the processed photographic material. Further, pyrazole or pyrazole derivatives having no N-methylol group can also be added. Further, in addition to the compound of the present invention, compounds for stabilizing dye images, such as hexamethylenetetramine, hexamethylenetetramine derivatives, hexahydrotriazine, hexahydrotriazine derivatives, dimethylol urea, and organic acids, and pH buffers can be contained. Further, if necessary, ammonium compounds, such as ammonium chloride and ammonium sulfite, compounds of metals, such as Bi and Al compounds, brightening agents, hardening agents, and alkanolamines described in U.S. Pat. No. 4,786,583 can be used.

The stabilizing solution used in the final processing step has generally a pH in the range of 4 to 9, with preference given to the range of 6 to 8. If the stabilizing liquid of the present invention is used in the final processing step, the replenishment rate is preferably 200 to 1,500 ml, particularly preferably 300 to 600 ml, per $m^2$ of the photographic material to be processed. If the stabilizing solution of the present invention is used in the final processing step, the processing temperature is preferably 30° to 45° C. The processing time is preferably 10 sec to 2 min, particularly preferably 15 to 30 sec.

Generally, after the silver halide photographic material is exposed to light imagewise, it is color-developed if the silver halide photographic material is of a negative type or a direct positive type, or it is subjected to black-and-white development, reversal processing, etc. and is color-developed if the silver halide photographic material is of a reversal positive type.

The color developer that can be used in the present invention is an aqueous alkali solution containing as a major component an aromatic primary amine color developing agent.

Preferable color-developing agents are p-phenylenediamine derivatives. Typical examples are shown below, but the present invention is not limited to them:

D-1 N,N-diethyl-p-phenylenediamine

D-2 2-methyl-N,N-diethyl-p-phenylenediamine

D-3 4-[N-ethyl-N-(β-hydroxyethyl)amino]aniline

D-4 2-methyl-4-[N-ethyl-N-(β-hydroxyethyl)amino]aniline

D-6 4-amino-3-methyl-N-ethyl-N-[β-(methanesulfonamido)ethyl]aniline

D-7 4-amino-3-methyl-N-ethyl-N-methoxyethylaniline

D-8 4-amino-3-methyl-N-ethyl-N-(4-hydroxybutyl)aniline

Out of the above p-phenylenediamine derivatives, D-4 and D-6 are particularly preferable.

Further, these p-phenylenediamine derivatives may be in the form of salts, such as sulfates, hydrochlorides, sulfites, and p-toluenesulfonates. Preferably the amount of the aromatic primary amine color developing agent to be used is 0.001 to 0.1 mol, more preferably 0.01 to 0.06 mol, per liter of the color developer.

To the color developer, can be added, if necessary, as a preservative, a sulfite, such as sodium sulfite, potassium sulfite, sodium bisulfite, potassium bisulfite, sodium metasulfite, and potassium metasulfite, or a carbonyl sulfurous acid adduct. A preferable amount of these preservatives to be added is 0.5 to 10 g, more preferably 1 to 5 g, per liter of the color developer.

As compounds that can directly preserve the above-mentioned aromatic primary amine color-developing agents, can be mentioned various hydroxylamines described in JP-A Nos. 5341/1988 and 106655/1988 (in particular, those compounds having a sulfo group or a carboxyl group are preferable), hydroxamic acids described in JP-A No. 43138/1988, hydrazides and hydrazines described in JP-A No. 146041/1988, phenols described in JP-A No. 44657/1988 and 58443/1988, α-hydroxyketones and α-aminoketones described in JP-A No. 44656/1988, and various saccharides described in JP-A No. 36244/1988. In combination with the above compounds, monoamines described, for example, in JP-A Nos. 4235/1988, 24254/1988, 21647/1988, 146040/1988, 27481/1988, and 25654/1988, diamines described, for example, in JP-A Nos. 30845/1988, 14640/1988, and 43139/1988, polyamines described in JP-A Nos. 21647/1988, 26655/1988, and 44655/1988, nitroxy radicals described in JP-A No. 53551/1988, alcohols described in JP-A No. 43140/1988 and 53549/1988, oximes described in JP-A No. 56654/1988, and tertiary amines described in JP-A No. 239447/1988 can be used.

As other preservatives, various metals described in JP-A Nos. 44148/1982 and 53749/1982, salicylic acids described in JP-A No. 180588/1984, alkanolamines described in JP-A No. 3582/1979, polyethyleneimines described in JP-A No. 94349/1981, and aromatic polyhydroxy compounds described in U.S. Pat. No. 3,746,544 can be contained if necessary. Particularly aromatic polyhydroxy compounds are preferably added.

The color developer for use in the present invention has preferably a pH of 9 to 12, more preferably a pH of 9 to 11.0.

To keep the above pH, various buffers are preferably used.

Specific examples of the buffer include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium p-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5sulfosalicylate). The amount of the buffer to be added is preferably 0.1 mol or more, particularly preferably 0.1 to 0.4 mol, per liter of the color developer.

In addition, in the color developer, preferably use is made of various chelating agents as precipitation-preventing agents for calcium and magnesium or for improving the stability of the color developer. As the chelating agent, organic acid compounds are preferable, such as aminopolycarboxylic acids, organic sulfonic acids, and phosphonocarboxylic acids.

Typical examples of them are diethylenetriaminepentaacetic acid, ethylenediaminetetraacetic acid, N,N,N-trimethylenephosphonic acid, ethylenediamine-N,N,N',N'-tetramethylenephosphonic acid, transcyclohexanediaminetetraacetic acid, 1,2-diaminopropanetetraacetic acid, hydroxyethyliminodiacetic acid, glycol ether diaminetetraacetic acid, ethylenediamineorthohydroxyphenylacetic acid, 2-phosphonobutane-1,2,4-tricarboxylic acid, 1-hydroxyethylidene-1,1-diphosphonic acid, and N,N'-bis(2-hydroxybenzyl)ethylenediamine-N,N'-diacetic acid, which may be used as a mixture of two or more if desired. The amount of the chelating agent to be added is an amount enough to sequester metal ions in the color developer and is, for example, on the order of 0.1 to 10 g per liter of the color developer.

To the color developer, if necessary, an arbitrary development accelerator can be added. However, preferably the color developer of the present invention substantially does not contain benzyl alcohol in view of the pollution, the solution preparation, and the prevention of color contamination. Herein "substantially does not contain" means that the amount of benzyl alcohol is 2 ml or below per liter of the color developer or that preferably the benzyl alcohol is not contained at all.

As other development accelerators, thioether compounds described, for example, in JP-B ("JP-B" means examined Japanese patent publication) Nos. 16088/1962, 5987/1962, 7826/1963, 12380/1969, and 9019/1970, and U.S. Pat. No. 3,818,247, p-phenylenediamine compounds described in JP-A Nos. 49829/1977 and 15554/1975, quaternary ammonium salts described, for example, in JP-A No. 137726/1975, JP-B No. 30074/1969, and JP-A Nos. 156826/1981 and 43429/1977, amine compounds described, for example, in U.S. Pat. Nos. 2,494,903, 3,128,182, 4,230,796, and 3,253,919, JP-B No. 11431/1966, and U.S. Pat. Nos. 2,482,546, 2,596,926, and 3,582,346, and polyalkylene oxides described, for example, in JP-B Nos. 16088/1962 and 25201/1967, U.S. Pat. No. 3,128,183, JP-B Nos. 11431/1966 and 23883/1967, and U.S. Pat. No. 3,532,501 as well as 1-phenyl-3-pyrazolidones and imidazoles can be added as required. The amount of the development accelerator to be added is on the order of 0.01 to 5 g per liter of the color developer.

In the present invention, if required, any antifoggant can be added. As the antifoggant, an alkali metal halide, such as sodium chloride, potassium chloride, and potassium iodide, and an organic antifoggant can be used. As typical examples of the organic antifoggant, nitrogen-containing heterocyclic compounds, such as benzotriazole, 6-nitrobenzimidazole, 5-nitroisoindazole, 5-methylbenzotriazole, 5-nitrobenzotriazole, 5-chlorobenzotriazole, 2-thiazolyl-benzimidazole, 2-thiazolylmethyl-benzimidazole, indazole, hydroxyazaindolizine, and adenine, can be mentioned. The amount of the antifoggant to be added is on the order of 0.001 to 1 g per liter of the color developer.

The color developer for use in the present invention may contain a fluorescent brightening agent. As the fluorescent brightening agent, a 4,4'-diamino-2,2'-disulfostilbene compound is preferable. The amount of the fluorescent brightening agent to be added is 0 to 5 g, preferably 0.1 to 4 g, per liter of the color developer.

If necessary, various surface-active agents, such as an alkyl sulfonic acid, an aryl sulfonic acid, an aliphatic carboxyl acids, an aromatic carboxylic acid, can be added.

The color-developing replenisher contains the compounds that are to be contained in the color developer. The role of the color-developing replenisher is to keep the development performance constant by supplying, to the color developer, compounds, which have been decreased by the processing of the photographic material and by their deterioration over time in the automatic processor, and by controlling the concentrations of compounds dissolved out from the photographic material by the processing. Therefore, the former compounds are higher in concentration than that of the color development tank solution, and the latter compounds are lower in concentration than that of the color development tank solution. The former compounds include a color-developing agent and a preservative, and they are contained in the replenisher in an amount of 1.1 to 2 times the amount in the tank solution. The latter compounds include a development restrainer, typically a halide (e.g., potassium bromide), and they are contained in the replenisher in an amount of 0 to 0.6 times the amount in the tank solution. Although generally the concentration of the halide in the replenisher is 0.06 mol/liter or less, a requirement that the lower the replenishing rate is, the more decreased the concentration is, and in some cases the replenisher contains no halides.

Generally compounds whose concentrations are hardly changed by the processing or over time are contained approximately in the same concentration as that of the color development tank solution. Examples thereof are chelating agents and buffers.

Further, the pH of the color-developing replenisher is about 0.05 to 0.5 higher than that of the tank solution, in order to prevent the pH of the tank solution from being lowered by the processing. A requirement that this difference of the pH is increased as the replenishing amount is decreased. The replenishing amount of the color developer is 300 ml or less, preferably 100 to 1,500 ml, per $m^2$ of the photographic material.

Suitably the processing temperature of the color-developing is 20° to 50° C., preferably 30° to 45° C. The processing time is suitably 20 sec to 5 min, preferably 30 sec to 3 min and 20 sec, and more preferably 1 min to 2 min and 30 sec.

The color-developing bath may be divided, if necessary, into two or more baths, and the color-developing replenisher may be supplied from the first bath or the last bath, to reduce the development time and to reduce the replenishment rate.

The processing method of the present invention can be preferably used for color reversal processing. The reversal processing includes black-and-white development; then, if required, reversal processing, and color development. The black-and-white developer used in this case is the generally used so-called black-and-white first developer used for reversal processing of color photographic materials, and it can contain various well-known additives that are added to black-and-white developers.

As typical additives can be mentioned developing agents, such as 1-phenyl-3-pyrazolidone, metol, and hydroquinone; preservatives, such as sulfates; accelerators of an alkali, such as sodium hydroxide, sodium carbonate, and potassium carbonate; organic or inorganic inhibitors, such as potassium bromide, 2-methylbenzimidazole, and methylbenzthiazole; water softeners, such as polyphosphates; and development restrainers comprising a trace amount of an iodide and a mercapto compound.

When the processing is carried out by using the above black-and-white developer or color developer and an automatic processor, preferably the area (opened area) where the developer (a color developer and a black-and-white developer) is in contact with the air is as small as possible. For example, if the opened surface ratio is defined as the value obtained by dividing the open area ($cm^2$) by the volume ($cm^3$) of the developer, the opened surface ratio is preferably 0.01 ($cm^{-1}$) or less, more preferably 0.005 or less.

The developer can be used by regenerating it.

The term "regeneration" of the developer means that the activity of the used developer is increased by using an anion exchange resin or electrodialysis, or by adding a treatment called a regenerant, so that the developer may be used again.

In this case, the regeneration rate (the rate of the overflow solution in the replenishing solution) is preferably 50% or more, particularly preferably 70% or more.

In processing in which the developer is regenerated, the overflow solution of the developer is regenerated to be used as a replenishing solution.

As the method for the regeneration, an anion exchange resin is used preferably. As a particularly preferable composition of an anion exchange resin and a method for the regeneration of the resin, those described in *Diaion Manual* (*I*) (14th edition, 1986), published by Mitsubishi Chemical Industries, Ltd. can be mentioned. Among anion exchange resins, resins having compositions described in JP-A Nos. 952/1990 and 281152/1989 are preferable.

The conditioning bath to be used for the reversal processing can contain an aminopolycarboxylic acid chelating agent, such as ethylenediaminetetraacetic acid, diethylenetriaminetetraacetic acid, 1,3-diaminopropanetetraacetic acid, and cyclohexanaediaminetetraacetic acid, and various bleach accelerators that are described in the section for the bleaching solution, such as sulfites, for example, sodium sulfite and ammonium sulfite, thioglycerin, aminoethanethiol, and sulfoethanethiol. In order to prevent scum from forming, preferably sorbitan esters of fatty acids substituted by ethylene oxide described in U.S. Pat. No. 4,839,262 and polyoxyethylene compounds described in Research Disclosure Vol. 191, 19104 (1980) are contained. These compounds are used in an amount in the range of 0.1 to 20 g, preferably 1 to 5 g, per liter of the conditioner.

Preferably the conditioning bath contains an image stabilizing agent that can be used in the above-mentioned stabilizing solution so that may have a stabilizing effect.

The pH of the conditioning bath is generally in the range of 3 to 11, preferably 4 to 9, and more preferably 4.5 to 7.

The processing time of the conditioning bath is preferably 30 sac to 5 min.

The replenishment ratio of the conditioning bath is preferably 30 to 3,000 ml, particularly preferably 50 to 1,500 ml, per $m^2$ of the photographic material.

The processing temperature of the conditioning bath is preferably 20° to 50° C., particularly preferably 30° to 40° C.

By introducing the over flow solution from the water washing step or stabilizing step to the preceding bath having fixing capacity, the amount of waste solution can be reduced, In processings, not only bleaching solution, bleach-fix solution, and fixing solution but also other processing solutions (e.g., color developer, washing solution, and stabilizing solution) are preferably replenished with suitable amount of water, replenisher, or processing replenisher, in order to correct the concentration due to evaporation of water.

In the present invention, effects are attained particularly effective, when the total processing time with processing solutions between after bleaching step and before entering in drying step is 1 to 3 min, preferably 1 min and 20 sec to 2 min.

In the present invention, the drying temperature is preferably 50° to 65° C., more preferably 50° to 60° C.

The drying time is preferably 30 sec to 2 min, more preferably 40 to 80 sec.

Suitably the photographic material in the present invention is provided with at least one blue-sensitive silver halide emulsion layer, at least one green-sensitive silver halide emulsion layer, and at least one red-sensitive silver halide emulsion layer on a support and there is no particular restrictions on the number and order of the silver halide emulsion layers and the nonphotosensitive layers. A typical example is a silver halide photographic material having on a support at least one photosensitive layer that comprises a plurality of silver halide emulsion layers whose color sensitivities are substantially identical but whose sensitivities are different, the photosensitive layer being a unit photosensitive layer having color sensitivity to any of blue light, green light, and red light, and in a multilayer silver halide color photographic material, the arrangement of the unit photosensitive layers is generally such that a red-sensitive layer, a green-sensitive layer, and a blue-sensitive layer in the order stated from the support side are placed. However, the above order may be reversed according to the purpose and such an order is possible that layers having the same color sensitivity have a layer different in color sensitivity therefrom between them.

Nonphotosensitive layers such as various intermediate layers may be placed between, on top of, or under the above-mentioned silver halide photographic layers.

The intermediate layer may contain, for example, couplers and DIR compounds as described in JP-A Nos. 43748/1986, 113438/1984, 113440/1984, 20037/1986, and 20038/1986 and may also contain a color mixing inhibitor as generally used.

Each of the silver halide emulsion layers constituting unit photosensitive layers respectively can preferably take a two-layer constitution comprising a high-sensitive emulsion layer and a low-sensitive emulsion layer as described in West Germany Patent No. 1,121,470 or British Patent No. 923,045. Generally, they are arranged preferably such that the sensitivities are decreased toward the support and each nonphotosensitive layer may be placed between the silver halide emulsion layers. As described, for example, in JP-A No. 112751/1982, 200350/1987, 206541/1987, and 206543/1987, a low-sensitive emulsion layer may be placed away from the support and a high-sensitive emulsion layer may be placed nearer to the support.

A specific example of the order includes an order of a low-sensitive blue-sensitive layer (BL)/high-sensitive blue-sensitive layer (BH)/high-sensitive green-sensitive layer (GH)/low-sensitive green-sensitive layer (GL)/high-sensitive red-sensitive layer (RH)/low-sensitive red-sensitive layer (RL), or an order of BH/BL/GL/GH/RH/RL, or an order of BH/BL/GH/GL/RL/RH stated from the side away from the support.

As described in JP-B No. 34932/1980, an order of a blue-sensitive layer/GH/RH/GL/RL stated from the side away from the support is also possible. Further, as described in JP-A Nos. 25738/1981 and 63936/1987, an order of a blue-sensitive layer/GL/RL/GH/RH stated from the side away from the support is also possible. Further, as described in JP-B No. 15495/1974, an arrangement is possible wherein the uppermost layer is a silver halide emulsion layer highest in sensitivity, the intermediate layer is a silver halide emulsion layer lower in sensitivity than that of the uppermost layer, the lower layer is a silver halide emulsion layer further lower in sensitivity than that of the intermediate layer so that the three layers different in sensitivity may be arranged with the sensitivities successively lowered toward the support. Even in such a constitution comprising three layers different in sensitivity, an order of a medium-sensitive emulsion layer/high-sensitive emulsion layer/low-sensitive emulsion layer stated from the side away from the support may be taken in layers identical in color sensitivity as described in JP-A No. 202464/1984. As stated above, various layer constitutions and arrangements can be selected in accordance with the purpose of the particular photosensitive material.

The dried film thickness of total constitutional layers, excluding the support and the undercoat layer and the backing layer of the support, is preferably 12.0 to 20.0 μm, more preferably 12.0 to 17.0 μm, in view of bleaching fog and aging stain.

The film thickness of photographic material is determined as follows:

The photographic material to be measured is stored for 7 days at 25° C. and 50% RH after preparation of the photographic material, and then the total thickness of the photographic material and the thickness remained after removing total coating layers on the support are measured. The difference of the above two thicknesses is the thickness of total coating layers excluding the support. The thickness can be measured, for example, by a film thickness gauge provided a piezoelecric-crystal element (e.g., K-402B Stand., manufactured by Anritsu Electric Co., Ltd.). The removing of coating film layers can be done using an aqueous sodium hypochloride solution. Further, the total thickness on the photographic material can be determined by a cross section photograph of the 10 above photographic material utilizing a scanning electron microscope (preferably the magnifying power is 3,000 or more).

In the present invention, the swelling ratio of the photographic material represented by the formula of

[(Swelled film thickness equilibrated in water at 20° C.—total thickness dried at 25° C. and 55% RH)/total thickness dried at 25° C. and 55% RH]×100 is preferably 50 to 200%, more preferably 70 to 150%. When the swelling ratio is out of the above-mentioned range, the residual amount of color developing agent increases, and photographic properties, image quality such as desilvering property, and film properties such as film strength may be affected.

Preferably the film swelling speed $T_{1/2}$ of the photographic material in the present invention is 15 sec or below, more preferably 9 sec or below, when the swelling speed $T_{1/2}$ is defined as the time required to reach a film thickness of ½ of the saturated film thickness that is 90% of the maximum swelled film thickness that will be reached when the film is treated with a color developer at 30° C. for 3 min 15 sec.

The silver halide to be contained in the photographic emulsion layer of the photographic material utilized in the present invention may be any of silver iodobromide, silver iodochlorobromide, silver chlorobromide, silver bromide, and silver chloride. A preferable silver halide is silver iodobromide, silver iodochloride, and silver iodochlorobromide, containing about 0.1 to 30 mol % silver iodide. A particularly preferable silver halide is a silver iodobromide containing about 2 to about 25 mol % of silver iodide.

The silver halide grains in the photographic emulsion may have a regular crystal form, such as a cubic shape, an octahedral shape, and a tetradecahedral shape, or a irregular crystal shape, such as spherical shape or a tabular shape, or they may have a crystal defect, such as twin planes, or they may have a composite crystal form.

The silver halide grains may be fine grains having a diameter of about 0.2 μm or less, or large-size grains with the diameter of the projected area being down to about 10 μm, and as the silver halide emulsion, a polydisperse emulsion or a monodisperse emulsion can be used.

The silver halide photographic emulsions that can be used in the present invention may be prepared suitably by known means, for example, by the methods described in *I. Emulsion Preparation and Types,* in *Research Disclosure* (RD) No. 17643 (December 1978), pp. 22–23, and ibid. No. 18716 (November 1979), p. 648, and ibid. No. 307105 (November, 1989), pp. 863–865; the methods described in P. Glafkides, *Chimie et Phisique Photographique,* Paul Montel (1967), in G. F. Duffin, *Photographic Emulsion Chemistry,* Focal Press (1966), and in V. L. Zelikman et al., *Making and Coating of Photographic Emulsion,* Focal Press (1964).

A monodisperse emulsion, such as described in U.S. Pat. Nos. 3,574,628 and 3,655,394, and in British Patent No. 1,413,748, is also preferable. A tabular grain having a aspect ratio of 5 or more can be used in the present invention. Tabular grains can be prepared by a method described in, for example, Gutoff, *Photographic Science and Engineering,* Vol. 14, pp.248–257 (1970), U.S. Pat. Nos. 4,434,226, 4,414,310, 4,430,048, and 4,439,520, and British Patent No. 2,112,157.

The crystal structure of silver halide grains may be uniform, the outer halogen composition of the crystal structure may be different from the inner halogen composition, or the crystal structure may be layered. Silver halides whose compositions are different may be joined by the epitaxial joint, or a silver halide may be joined, for example, to a compound other than silver halides, such as silver rhodanide, lead oxide, etc.

Mixture of grains having various crystal form may also be used.

The silver halide emulsion that has been physically ripened, chemically ripened, and spectrally sensitized is generally used. Additives to be used in these steps are described in *Research Disclosure* Nos. 17643 (December, 1978), 18716 (November, 1979), and 307105 (November, 1989), and involved sections are listed in the Table shown below.

Known photographic additives that can be used in the present invention are also described in the above-mentioned three Research Disclosures, and involved sections are listed in the same Table below.

| Additive | RD 17643 | RD 18716 | RD 307105 |
|---|---|---|---|
| 1 Chemical sensitizer | p. 23 | p. 648 (right column) | p. 866 |
| 2 Sensitivity-enhancing agent | — | p. 648 (right column) | — |
| 3 Spectral sensitizers and Supersensitizers | pp. 23–24 | pp. 648 (right column)–p. 649 (right column) | pp. 866–868 |
| 4 Brightening agents | p. 24 | p. 647 (right column) | p. 868 |
| 5 Antifogging agents and Stabilizers | pp. 24–25 | p. 649 (right column) | pp. 868–870 |
| 6 Light absorbers, Filter | pp. 25–26 | pp. 649 (right column)– | p. 873 |

-continued

| Additive | RD 17643 | RD 18716 | RD 307105 |
|---|---|---|---|
| dyes, and UV Absorbers | | 650 (left column) | |
| 7 Stain-preventing agent | p. 25 (right column) | p. 650 (left to right column) | p. 872 |
| 8 Image dye stabilizers | p. 25 | p. 650 (left column) | p. 872 |
| 9 Hardeners | p. 26 | p. 651 (left column) | pp. 874–875 |
| 10 Binders | p. 26 | p. 651 (left column) | pp. 873–874 |
| 11 Plasticizers and Lubricants | p. 27 | p. 650 (right column) | p. 876 |
| 12 Coating aids and Surface-active agents | pp. 26–27 | p. 650 (right column) | pp. 875–876 |
| 13 Antistatic agents | p. 27 | p. 650 (right column) | pp. 876–877 |
| 14 Matting agent | — | — | pp. 878–879 |

In the present invention, various color couplers can be used in a combined use, and representative examples thereof are those as described in patents in the above-mentioned RD Nos. 17643, VII-C-G and 307105, VII-C-G.

As yellow couplers, those described in, for example, U.S. Pat. Nos. 3,933,501, 4,022,620, 4,326,024, 4,401,752, and 4,248,961, JP-B No. 10739/1983, British Patent Nos. 1,425,020 and 1,476,760, U.S. Pat. Nos. 3,973,968, 4,314,023, and 4,511,649, and European Patent No. 249,473A are preferable.

As magenta couplers, 2-equivalent and/or 4-equivalent 5-pyrazolone-series compounds and pyrazoloazole-series compounds are preferable, and couplers described in, for example, U.S. Pat. Nos. 4,310,619 and 4,351,897, European Patent No. 73,636, U.S. Pat. Nos. 3,061,432 and 3,725,067, *Research Disclosure* No. 24220 (June 1984), JP-A No. 33552/1985, *Research Disclosure* No. 24230 (June 1984), JP-A Nos. 43659/1985, 72238/1986, 35730/1985, 118034/1980, and 185951/1985, U.S. Pat. Nos.4,500,630, 4,540,654 and 4,556,630, and WO(PCT) No. 88/04795 are preferable, in particular.

As cyan couplers, phenol-series couplers and naphthol-series couplers can be mentioned, and those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent Application (OLS) No. 3,329,729, European Patent Nos. 121,365A and 249,453A, U.S. Pat. Nos. 3,446,622, 4,333,999, 4,753,871, 4,451,559, 4,427,767, 4,690,889, 4,254,212, and 4,296,199, and JP-A No. 42658/1986 are preferable.

As a colored coupler to rectify the unnecessary absorption of color-forming dyes, those couplers described in, paragraph VII-G of *Research Disclosure* No. 17643, paragraph VII-G of ibid. No. 307105, U.S. Pat. No. 4,163,670, JP-B No. 39413/1982, U.S. Pat. Nos. 4,004,929 and 4,138,258, and British Patent No. 1,146,368 are preferable. Further, it is preferable to use couplers to rectify the unnecessary absorption of color-forming dyes by a fluorescent dye released upon the coupling reaction as described in U.S. Pat. No. 4,774,181 and couplers having a dye precursor, as a group capable of being released, that can react with the developing agent to form a dye as described in U.S. Pat. No. 4,777,120.

As a coupler which forms a dye having moderate diffusibility, those described in U.S. Pat. No. 4,366,237, British Patent No. 2,125,570, European Patent No. 96,570, and West German Patent Application (OLS) No. 3,234,533 are preferable.

Typical examples of polymerized dye-forming coupler are described in, for example, U.S. Pat. Nos. 3,451,820, 4,080,211, 4,367,282, 4,409,320, and 4,576,910, and British Patent No. 2,102,173.

A compound that releases a photographically useful residue accompanied with the coupling reaction can be used favorably in this invention. As a coupler that releases, imagewisely, a nucleating agent or a development accelerator upon developing, those described in British Patent Nos. 2,097,140 and 2,131,188, and JP-A Nos. 157638/1984 and 170840/1984 are preferable.

Other compounds that can be incorporated in the photographic material of the present invention include competitive couplers described in U.S. Pat. No. 4,130,427, couplers which release a dye to regain a color after releasing as described in European Patent Nos. 173,302A and 313,308A, couplers which release a bleaching accelerator as described in RD Nos. 11449 and 24241, and JP-A No. 201247/1986, couplers which release a ligand as described in U.S. Pat. No. 4,555,477, couplers which release a leuco dye as described in JP-A No. 75747/1988, and couplers which release a fluorescent dye as described in U.S. Pat. No. 4,774,181.

Couplers utilized in the present invention can be incorporated into a photographic material by various known dispersion methods.

Examples of high-boiling solvent for use in oil-in-water dispersion process are described in, for example, U.S. Pat. No. 2,322,027, and as specific examples of high-boiling organic solvent having a boiling point of 175° C. or over at atmospheric pressure for use in oil-in-water dispersion process can be mentioned phthalates [e.g., dibutyl phthalate, dicyclohexyl phthalate, di-2-ethylhexyl phthalate, decyl phthalate, bis(2,4-di-t-amylphenyl) phthalate, bis(2,4-di-t-amylphenyl) isophthalate, and bis(1,1-diethylpropyl)phthalate]; esters of phosphoric acid or phosphonic acid (e.g., triphenyl phosphate, tricrezyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, and di-2-ethylhexylphenyl phosphate); benzoic esters (e.g., 2-ethylhexyl benzoate, dodecyl benzoate, and 2-ethylhexyl-p-hydroxy benzoate); amides (e.g., N,N-diethyldodecanamide, N,N-diethyllaurylamide, and N-tetradecylpyrrolidone); alcohols or phenols (e.g., isostearyl alcohol and 2,4-di-t-amyl phenol); aliphatic carbonic acid esters (e.g., bis(2-ethylhexyl) sebacate, dioctyl azelate, glycerol tributylate, isostearyl lactate, and trioctyl citrate); aniline derivatives (e.g., N,N-dibutyl-2-butoxy-5-t-octylaniline); and hydrocarbons (e.g., paraffin, dodecyl benzene, and diisopropyl naphthalene). Further, as a co-solvent an organic solvent having a boiling point of about 30° C. or over, preferably a boiling point in the range from 50° C. to about 160° C. can be used, and as typical example can be mentioned ethyl acetate, butyl acetate, ethyl propionate, methylethyl ketone, cyclohexanone, 2-ethoxyethyl acetate, and dimethyl formamide.

Specific examples of process and effects of latex dispersion method, and latices for impregnation are described in, for example, U.S. Pat. No. 4,199,363 and West German Patent Application (OLS) Nos. 2,541,274 and 2,541,230.

These couplers can also be emulsified and dispersed into an aqueous hydrophilic colloid solution by impregnating them into a loadable latex polymer (e.g., U.S. Pat. No. 4.,203,716) in the presence or absence of the above-mentioned high-boiling organic solvent, or by dissolving them in a polymer insoluble in water and soluble in organic solvents. Preferably, homopolymers and copolymers described in International Publication Patent No. WO 88/00723. pp. 12 to 30, are used. Particularly, the use of arylamide-series polymers is preferable because, for example, dye images are stabilized.

The case wherein the present invention is utilized in the treatment for silver halide black-and-white photographic material is described below.

In the developer for use in the development processing of silver halide black-and-white photographic material, additives usually used (e.g., a developing agent, an alkaline agent, a pH-buffer, a preservative, and a chelating agent) can be contained. In the processing according to the present invention, any known method can be used, and any known processing solution can be used. Although the processing temperature is selected generally from the range of 8° to 50° C., it may be the temperature lower than 18° C. or the temperature higher than 50° C. In the black-and-white developer, known developing agent, such as dihydroxybenzenes, 1-phenyl-3-pyrazolidones, and aminophenols, is used alone of in combination thereof.

As a dihydroxybenzene-series developing agent can be mentioned, for example, hydroquinone, chlorohydroquinone, bromohydroquinone, isopropylhydroquinone, methyl-hydroquinone, 2,3-dichlorohydroquinone, and 2,3-dibromo-hydroquinone. Among them, hydroquinone is particularly preferable. Examples of 1-phenol-3-pyrazolidone or derivatives thereof, as assistant developing agent, include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, and 1-p-tolyl-4,4-dimethyl-3-pyrazolidone.

As p-amionphenol-series assistant developing agent can be mentioned N-methyl-p-aminophenol, p-aminophenol, N-(β-hydroxyethyl)-p-aminophenol, N-(4-hydroxyphenyl)glycin, 2-methyl-p-aminophenol, and p-benzylaminophenol. Among them, N-methyl-p-aminophenol is preferable. Preferably dihydroxybenzene-series developing agent is used in an amount of 0.05 to 0.8 mol/liter. When a hydrozybenzene and a 1-phenyl-3-pyrazolidone or a p-aminophenol are used in combination, preferably, the former is used in an amount of 0.05 to 0.5 mol/liter, and the later is used in an amount of 0.06 mol/liter or less.

As sulfite-preservatives can be mentioned sodium sulfite, potassium sulfite, lithium sulfite, sodium hydrogensulfite, potassium methahydrogensulfite, and sodium formaldehydehydrogensulfite.

In a black-and-white developer, particularly in 20 a developer of graphic arts, sulfite is used in an amount of 0.3 mol/liter or more. Preferably the upper limit of sulfite is 1.2 mol/liter or less, because excess addition causes precipitate, resulting solution contamination.

Examples of alkaline agent for use in the developer of the present invention include pH-adjusting agents and buffers, such as sodium hydroxide, potassium hydroxide, sodium carbonate, potassium carbonate, sodium tertiary phosphate, potassium tertiary phosphate, sodium silicate, and potassium silicate.

As additives that can be used besides the above-mentioned elements, can be mentioned a development restrainer, such as compounds including boric acid and borax, sodium bromide, potassium bromide, and potassium iodide; an organic solvent, such as ethylene glycol, diethylene glycol, triethylene glycol, dimethylformamide, methyl cellosolve, hexylene glycol, ethanol, and methanol; an antifogging agent or black pepper-preventing agent, such as mercapto compounds including 1-phenyl-5-mercaptotetrazole and sodium 2-mercaptobenzimidazole-5-sulfonate, indazole compounds including 5-nitroindazole, benztriazole compounds including 5-methylbenztriazole. Further, a tone-conditioning agent, a surface-active agent, an antiformer, an water softener, or a film-hardening agent can be contained according to needs.

In the developer for use in the present invention, compound as a silver contamination-preventing agent described, for example in JP-A No.24347/1981; compound as a developer streaks-preventing agent described, for example in JP-A No. 212651/1987; and compound as a assistant solvent described, for example in JP-A No. 267759/1986 can be used. In the developer for use in the present invention, boric acid as a buffer described, for example in JP-A No. 186259/1987, and saccharides (e.g., sucrose), oximes (e.g., acetoxime), phenols (e.g., 5-sulfosalicilic acid), and tertiary phosphate (e.g., sodium salt and potassium salt) can be used.

The fixing solution is an aqueous solution containing, besides a fixing agent, a hardening agent (e.g., an water soluble aluminum compound), acetic acid and a dibasic acid (e.g., tartaric acid and citric acid or salts thereof), if needed, and the pH of the fixing solution is preferably 3.8 or higher, more preferably 4.0 to 7.5. The water soluble ammonium salt that acts as mainly hardening agent is a known compound as a hardening agent in hardening fixing solution, and examples thereof include, for example ammonium chloride, aluminum sulfate, and potassium alum. As the above-mentioned dibasic acid, tartaric acid (including its sodium salt and its potassium salt) or its derivatives, or citric acid (including its sodium salt and its potassium salt) or its derivatives can be used alone or in combination of two or more thereof. Effectively these compounds are contained in an amount of 0.005 mol or more, more preferably 0.01 to 0.03 mol, per liter of the fixing solution.

The fixing solution can contain, if necessary, a pH-buffer (e.g., acetic acid and boric acid), a pH-adjusting agent (e.g., ammonia and sulfuric acid), an image-sotrageability-improving agent (e.g., potassium iodide), or a chelating agent. Herein, the pH-adjusting agent is preferably used in an amount of 10 to 40 g per liter, more preferably 18 to 25 g per liter, because the pH of developer is in a higher range. The temperature and time of fixing process are the same as those of developing, for example, about 20° to about 50° C. and 10 sec to 1 min, respectively.

To details other than the above-described of the fixing solution are applied the description of the fixing solution for use in the color photographic material above described. Further, the water-washing solution can contain a mildew proofing agent (e.g., compound described in Horiguchi, *Bokin Bobai-zai no Kagaku* or Japanese Patent Application No. 253807/1985), water washing accelerator (e.g., sulfite), and chelating agent. The replenishing rate of water washing solution may be 1,200 ml/m$^2$ or less including 0). The terms "the replenishing rate of water washing (or stabilizing) solution is 0" means an water washing method of so-called accumulated water washing method. As low-replenishing-rate method multistage (e.g., 2-stage and 3-stage) counter-current system is known already.

For problems which occur in the case of low-replenishing-rate of water such as washing water, good processing properties can be attained by utilizing the combination of the techniques described in the processing of color photographic material.

When water washing is carried out by a small amount of water in the present invention, more preferably a squeeze roller or crossover rack washing tank is provided as described in, for example, JP-A Nos. 18350/1988 and 287252/1987. Further, a part or all of overflow solution from water washing or stabilizing bath generated by replenishing of mildew-proofed water according to needs can be utilized in the preceding bath having fixing capacity, as described in, for example, JP-A Nos. 235133/1985 and 129343/1988. Further, an water soluble surface-active agent or antifoamer can be added to prevent occurrence of water spots when water washing is carried out by using a small amount of water, and/or transferring of processing agents adhered on a squeeze roller to the film processed. The dye-absorbing agent as described in, for example JP-A No. 163456/1985 may be provided in the water washing bath for prevention of contamination due to dyes dissolved from the photographic material.

According to the above-described method, the developed and fixed photographic material is water washed and dried. The water washing is conducted in order to almost perfectly remove silver salts dissolved by fixing process, and preferably conducted at about 20° to about 50° C. for 10 sec to 3 min. Drying is conducted at about 40° to about 100° C., wherein the drying time may be suitably changed according to the condition of atmosphere, but it may be generally 5 sec to 3 min and 30 sec.

A roller carrying-type automatic processor is described in, for example, U.S. Pat. Nos. 3,025,779 and 3,545,971, and in the present specification it is referred to as the roller carrying-type processor. The roller carrying processor is constituted of 4 steps, that is, 15 developing, fixing, water washing, and drying, and the method according to the present invention most preferably follows to these 4 steps, even not excluding some other steps (e.g., stopping process). Herein, an water-saving treatment may be carried out by an water washing process of 2 to 3 steps countercurrent washing mode.

The fixing solution of the present invention and the fixing solution for use in the present invention are preferably stored using the packaging material having a low air permeability as described in, for example JP-A No. 73147/1986. Further, processing solutions for use in the present invention preferably utilizes the replenishing system described in, for example JP-A No. 91939/1987.

As the photographic material according to the present invention can be mentioned, for example, an usual black-and-white silver halide photographic material (e.g., a black-and-white photographic material for photographing, a black-and-white photographic material for X-ray photographing, and a black-and-white photographic material for printing), an usual multilayer silver halide color photographic material (e.g., a color negative film, a color reversal film, a color positive film, a color negative film for movie, a color printing paper, a reversal color printing paper, and a direct positive color printing paper), an infrared-sensitive photographic material for laser scanning.

The thickness of support of color negative film for use in the present invention is preferably 70 to 130 μm, and as the raw material various plastics film as described in, for example, JP-A. No. 124636/1992, p. 5, right upper column line 1 to p.6, right upper column line 5, can be used, and as preferable ones can be mentioned a cellulose derivative (e.g., diacetyl-, triacetyl-, propionyl-, butanoyl-, and acetyl-propionyl-acetate), and a polyester described in, for example JP-B No. 40414/1973 (e.g., polyethylene terephthalate, poly-1,4-cyclohexanedimethylene terephthalate, and polyethylene naphthalate). Preferably a polyester film is used as a film support for the present invention, because a higher water draining effect can be attained.

Preferably the support of the color negative film for use in the present invention is one having a conductivity-layer and a transparent magnetic material-layer on one side, one having a magnetic recording layer as described in, for example International Publication Patent No. WO90/04205, FIG. 1A, and one having a stripe magnetic recording layer and a transparent magnetic recording layer adjacent to the stripe magnetic recording layer described in, for example JP-A No. 124628/1992. On these magnetic recording layer, preferably a protective layer is provided, as described in, for example JP-a No. 73737/1992.

Although a package (patrone or magazine) receiving the color negative film of the present invention may be any of present used-types and known ones, in particular, one having a shape described in U.S. Pat. No. 4,834,306, FIGS. 1 to 3, or U.S. Pat. No. 4,846,418, FIGS. 1 to 3 is preferable.

According to the present invention, a novel composition having fixing capacity utilizing the compound represented by formula (I) or (II) alone or in combination with a fixing agent such as thiosulfate can be supplied. That is, the compound represented by formula (I) or (II) can be used as a fixing agent or fixing accelerator.

According to the present invention, a processing process wherein the fixing is not delayed even in a low-replenishing-rate processing.

Next, the present invention will be described in detail in accordance with examples, but the invention is not limited to them.

EXAMPLE 1

Sample 101 of a multilayer color photographic material was prepared by coating respective layers having compositions shown below on an undercoated triacetate cellulose film.

Composition of Photosensitive Layer

Raw materials for use in respective layers were classified as follows;

ExC: Cyan coupler

ExM: Magenta coupler

ExY: Yellow coupler

ExS: Sensitizing dye

ExU: UV absorber

HBS: High-boiling organic solvent

ExO: Color-mix inhibitor

W: Surface-active agent

H: Gelatin hardening agent

B: Polymer

S: Formalin scavenger or antifoggant

F: Additive (stabilizer or antifoggant, etc.)

Figures corresponding to each component are coating amounts represented by $g/m^2$, and, with respect to silver halide, they are shown in terms of silver, provided that the sensitizing dye are shown as coating amount in mol per mol of silver halide in the same layer.

(Sample 1)

First layer (Halation-preventing layer)

| | | |
|---|---|---|
| Black colloidal silver | silver | 0.090 |
| Dispersion A dispersed solid organic dye | | 10.0 |
| Dispersion B dispersed solid organic dye | | 5.0 |
| Gelatin | | 1.4 |

Second layer (Intermediate layer)

| | | |
|---|---|---|
| 2,5-Di-t-pentadecylhydroquinone | | 0.18 |
| ExM-1 | | 0.070 |
| ExC-1 | | 0.020 |
| ExS-1 | | 0.0020 |
| ExU-1 | | 0.060 |
| ExU-2 | | 0.080 |
| ExU-3 | | 0.10 |
| HBS-1 | | 0.10 |
| HBS-2 | | 0.020 |
| Gelatin | | 1.0 |

Third layer (Low sensitivity red-sensitive emulsion layer)

| | | |
|---|---|---|
| Silver iodobromide emulsion A | silver | 0.25 |
| Silver iodobromide emulsion B | silver | 0.25 |
| ExS-3 | | $1.5 \times 10^{-4}$ |
| ExS-4 | | $1.8 \times 10^{-5}$ |
| ExS-5 | | $2.5 \times 10^{-4}$ |
| ExC-2 | | 0.020 |
| ExC-3 | | 0.17 |
| ExC-4 | | 0.17 |
| ExC-5 | | 0.020 |
| ExM-3 | | 0.020 |
| ExU-1 | | 0.070 |
| ExU-2 | | 0.050 |
| ExU-3 | | 0.070 |
| HBS-1 | | 0.060 |
| Gelatin | | 0.87 |

Fourth layer (Medium sensitivity red-sensitive emulsion layer)

| | | |
|---|---|---|
| Silver iodibromide emulsion B | silver | 1.60 |
| ExS-3 | | $1.0 \times 10^{-4}$ |
| ExS-4 | | $1.4 \times 10^{-5}$ |
| ExS-5 | | $2.0 \times 10^{-4}$ |
| ExC-1 | | 0.010 |
| ExC-2 | | 0.010 |
| ExC-3 | | 0.050 |
| ExC-4 | | 0.050 |
| ExC-6 | | 0.080 |
| Gelatin | | 0.70 |

Fifth layer (High sensitivity red-sensitive emulsion layer)

| | | |
|---|---|---|
| Silver iodobromide emulkion G | silver | 1.0 |
| ExS-3 | | $1.0 \times 10^{-4}$ |
| ExS-4 | | $1.4 \times 10^{-5}$ |
| ExS-5 | | $2.0 \times 10^{-4}$ |
| ExC-1 | | 0.050 |
| ExC-2 | | 0.015 |
| ExC-3 | | 0.20 |
| ExC-4 | | 0.20 |
| ExC-7 | | 0.20 |
| ExC-8 | | 0.020 |
| ExU-1 | | 0.070 |
| ExU-2 | | 0.050 |
| ExU-3 | | 0.070 |
| HBS-1 | | 0.22 |
| HBS-2 | | 0.10 |
| Gelatin | | 1.6 |

Sixth layer (Intermediate layer)

| | | |
|---|---|---|
| ExO-1 | | 0.040 |
| ExM-4 | | 0.050 |
| HBS-1 | | 0.020 |
| Gelatin | | 0.80 |

Seventh layer (Low sensitivity green-sensitive emulsion layer)

| | | |
|---|---|---|
| Silver iodobromide emulsion A | silver | 0.15 |

-continued (Sample 1)

| | | |
|---|---|---|
| Silver iodobromide emulsion B | silver | 0.15 |
| Silver iodobromide emulsion C | silver | 0.10 |
| ExS-2 | | $5.0 \times 10^{-5}$ |
| ExS-6 | | $3.0 \times 10^{-5}$ |
| ExS-7 | | $1.0 \times 10^{-4}$ |
| ExS-8 | | $3.8 \times 10^{-4}$ |
| ExM-1 | | 0.021 |
| ExM-3 | | 0.030 |
| ExM-5 | | 0.20 |
| ExM-6 | | 0.0050 |
| ExM-7 | | 0.10 |
| HBS-1 | | 0.10 |
| HBS-3 | | 0.010 |
| Gelatin | | 0.63 |

Eighth layer (Intermediate layer)

| | | |
|---|---|---|
| ExM-4 | | 0.018 |
| ExC-8 | | 0.040 |
| HBS-1 | | 0.16 |
| HBS-3 | | 0.0080 |
| Gelatin | | 0.50 |

Ninth layer (High sensitivity green-sensitive emulsion layer)

| | | |
|---|---|---|
| Silver iodobromide emulsion E | silver | 1.2 |
| ExS-2 | | $0.50 \times 10^{-5}$ |
| ExS-6 | | $3.5 \times 10^{-5}$ |
| ExS-7 | | $8.0 \times 10^{-5}$ |
| ExS-8 | | $3. \times 10^{-4}$ |
| ExM-3 | | 0.025 |
| ExM-8 | | 0.015 |
| ExM-9 | | 0.50 |
| ExY-1 | | 0.020 |
| HBS-1 | | 0.25 |
| HBS-2 | | 0.10 |
| Gelatin | | 1.5 |

Tenth layer (Intermediate layer)

| | | |
|---|---|---|
| ExO-1 | | 0.040 |
| HBS-1 | | 0.020 |
| Gelatin | | 0.80 |

Eleventh layer (Donor layer of interlayer effect to red-sensitive layer)

| | | |
|---|---|---|
| Silver iodobromide emulsion J | silver | 1.2 |
| Silver iodobromide emulsion K | silver | 2.0 |
| ExS-2 | | $4.0 \times 10^{-4}$ |
| ExC-2 | | 0.10 |
| ExM-2 | | 0.10 |
| HBS-1 | | 0.10 |
| HBS-2 | | 0.10 |
| Gelatin | | 0.80 |

Twelfth layer (Yellow filter layer)

| | | |
|---|---|---|
| Yellow colloidal silver | silver | 0.050 |
| Dispersion B dispersed solid organic dye | | 15.0 |
| ExO-1 | | 0.080 |
| HBS-1 | | 0.030 |
| Gelatin | | 0.95 |

Thirteenth layer (Low sensitivity blue-sensitive emulsion layer)

| | | |
|---|---|---|
| Silver iodobromide emulsion A | silver | 0.080 |
| Silver iodobromide emulsion B | silver | 0.070 |
| Silver iodobromide emulsion F | silver | 0.070 |
| ExS-9 | | $3.5 \times 10^{-4}$ |
| ExC-3 | | 0.042 |
| ExY-2 | | 0.72 |
| ExY-3 | | 0.020 |
| HBS-1 | | 0.28 |
| Gelatin | | 1.1 |

Fourteenth layer (Medium sensitivity blue-sensitive emulsion layer)

| | | |
|---|---|---|
| Silver iodobromide emulsion g | silver | 0.45 |
| ExS-9 | | $2.1 \times 10^{-4}$ |
| ExY-2 | | 0.15 |
| ExC-2 | | 0.0070 |

-continued

| (Sample 1) | | |
|---|---|---|
| HBS-1 | | 0.050 |
| Gelatin | | 0.78 |
| Fifteenth layer (High sensitivity blue-sensitive emulsion layer) | | |
| Silver iodobromide emulsion H | silver | 0.77 |
| ExS-9 | | $2.2 \times 10^{-4}$ |
| ExY-1 | | 0.010 |
| ExY-2 | | 0.60 |
| ExY-3 | | 0.010 |
| HBS-1 | | 0.070 |
| Gelatin | | 0.69 |
| Sixteenth layer (Protective layer) | | |

-continued

| (Sample 1) | | |
|---|---|---|
| Silver iodobromide emulsion I | silver | 0.20 |
| ExU-4 | | 0.11 |
| ExU-5 | | 0.17 |
| HBS-1 | | 0.050 |
| Dispersion A dispersed solid organic dye | | 0.50 |
| Dispersion B dispersed solid organic dye | | 0.50 |
| W-1 | | 0.020 |
| H-1 | | 0.40 |
| B-1 (diameter ca. 1.5 μm) | | 0.10 |
| B-2 (diameter ca. 1.5 μm) | | 0.10 |
| B-3 | | 0.020 |
| S-1 | | 0.20 |
| Gelatin | | 1.8 |

To the thus-prepared sample, besides the above-mentioned components, 1,2-benzisothiazoline-3-one (average ppm to gelatin); n-butyl-p-hydroxybenzoate (about 1,000 ppm to gelatin), and 2-phenoxyethanol (about 10,000 ppm to gelatin) were added. Further, W-2, W-3, B-4 to B-6, F-1 to F-17 and iron salt, lead salt, gold salt, platinum salt, iridium salt, rhodium salt were contained.

Preparation of Dispersion A of Solid Organic Disperse Dye

ExF-1 described below was dispersed by the following method. That is, 21.7 ml of water, 3 ml of 5% aqueous solution of sodium p-octylphenoxyethoxyethanesulfonate, and 0.5 g of 5% aqueous solution of p-octylphenoxypolyoxyethyleneether (polymerization degree: 10) were introduced into a pot mill of 700 ml, and 5.0 g of dye ExF-1 and 500 ml of zirconium oxide beads (diameter: 1 mm) were added thereto, followed by dispersing the contents for 2 hours. BO-type vibration ball mill, made by Chuo Koki was used for dispersing. After dispersing, the contents were taken out, 8 g of 12.5% aqueous gelatin solution was added, and beads were filtered off, thereby preparing dye dispersion A in gelatin.

Preparation of Dispersion B of Solid Organic Disperse Dye

Dispersion B was prepared in the same manner as Dispersion A, except that dye ExF-1 was changed dye ExF-2 shown below.

TABLE 1

| Emulsion | Average AgI content (%) | Average grain diameter (μm) | Deviation coefficient concerning grain diameter (%) | Ratio of diameter/ thickness | Ratio of silver amount (AgI content %) | |
|---|---|---|---|---|---|---|
| A | 4.0 | 0.45 | 27 | 1 | Core/shell = 1/3(13/1) | Double structure grains |
| B | 8.9 | 0.70 | 14 | 1 | Core/shell = 3/7(25/2) | Double structure grains |
| C | 10 | 0.75 | 30 | 2 | Core/shell = 1/2(24/3) | Double structure grains |
| D | 16 | 1.05 | 35 | 2 | Core/shell = 4/6(40/0) | Double structure grains |
| E | 10 | 1.05 | 35 | 3 | Core/shell = 1/2(24/3) | Double structure grains |
| F | 4.0 | 0.25 | 28 | 1 | Core/shell = 1/3(13/1) | Double structure grains |
| G | 14.0 | 0.75 | 25 | 2 | Core/shell = 1/2(42/0) | Double structure grains |
| H | 14.5 | 1.30 | 25 | 3 | Core/shell = 37/63(34/3) | Double structure grains |
| I | 1 | 0.07 | 15 | 1 | Uniform grains | |
| J | 5 | 0.90 | 30 | 2 | Core/shell = 1/1(10/0) | Double structure grains |
| K | 7 | 1.50 | 25 | 2 | Core/shell = 1/1(14/0) | Double structure grains |

In Table 1:

(1) Emulsions A to K were subjected to reduction sensitization using thiourea dioxide and thiosulfonic acid in accordance with Examples given in JP-A No. 191938/1990 when the grains were prepared.

(2) Emulsions A to K were subjected to gold sensitization, sulfur sensitization, and selenium sensitization using in the presence of sodium thiocyanate and spectrally sensitizing dyes stated for the respective photosensitive layers in accordance with Examples given in JP-A No. 237450/1991.

(3) In the preparation of tabular grains, low-molecular weight gelatins were used in accordance with Examples given in JP-A No. 158426/1989.

(4) Rearrangement lines as described in JP-A No. 237450/1991 were observed in the tabular grains under a high-voltage electron microscope.

Compounds added to the layers are shown below.

ExM-1
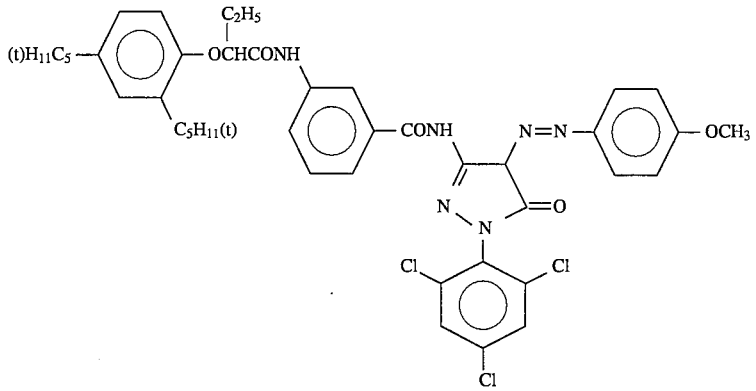
ExM-2
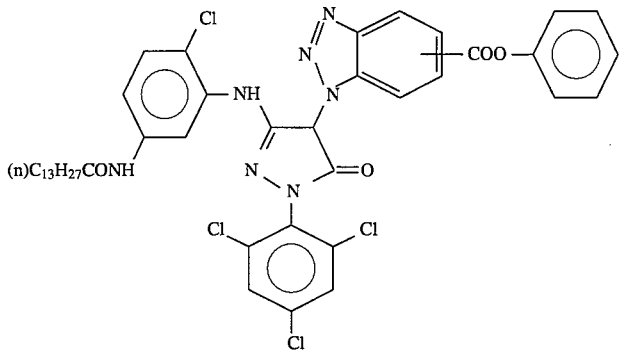
ExM-3
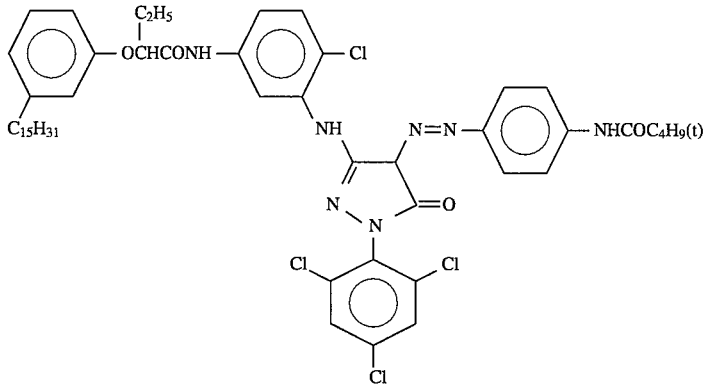
ExM-4
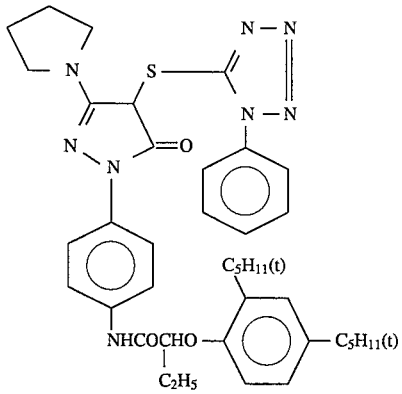

-continued
ExM-5
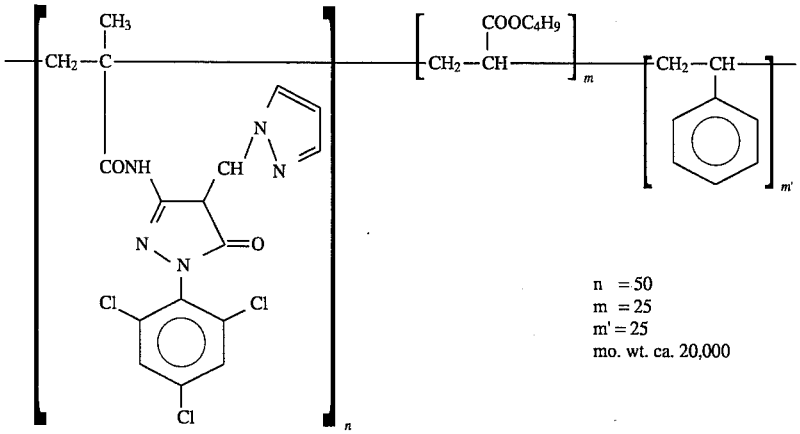
n = 50
m = 25
m' = 25
mo. wt. ca. 20,000
ExM-6
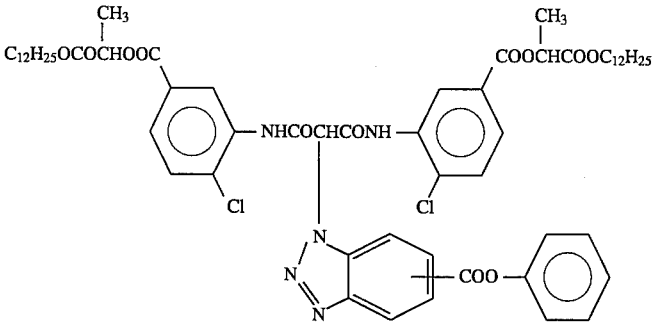
ExM-7
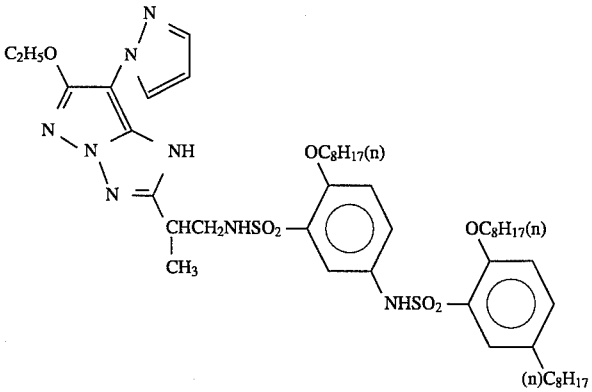
ExM-8
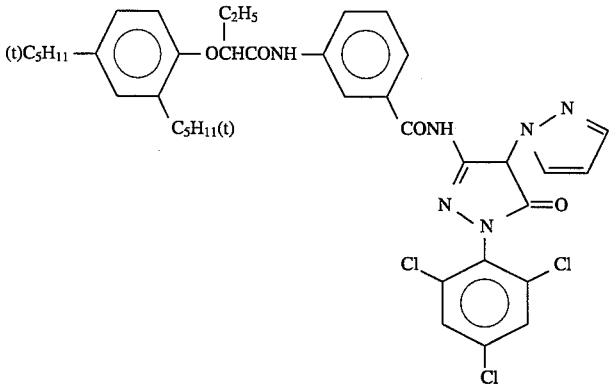

-continued
ExM-9
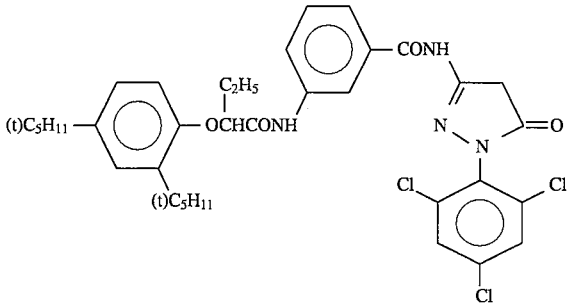
ExC-1
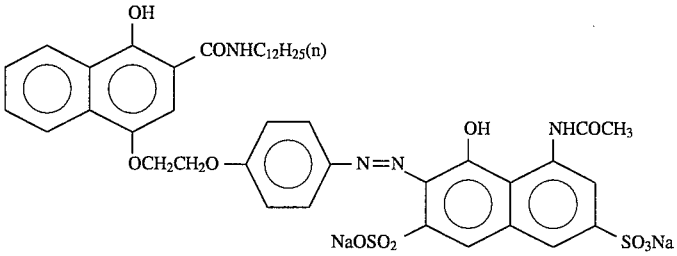
ExC-2
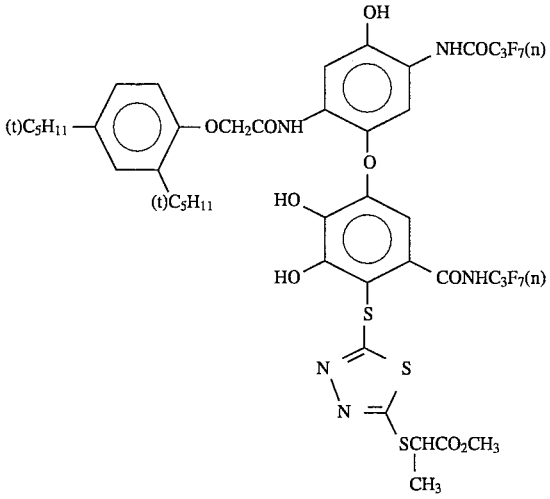
ExC-3
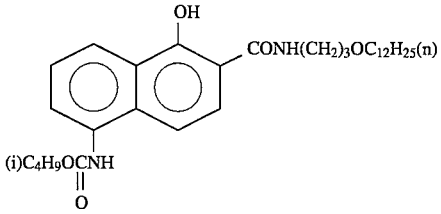
ExC-4
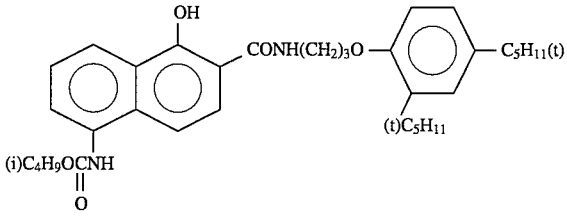

-continued
ExC-5
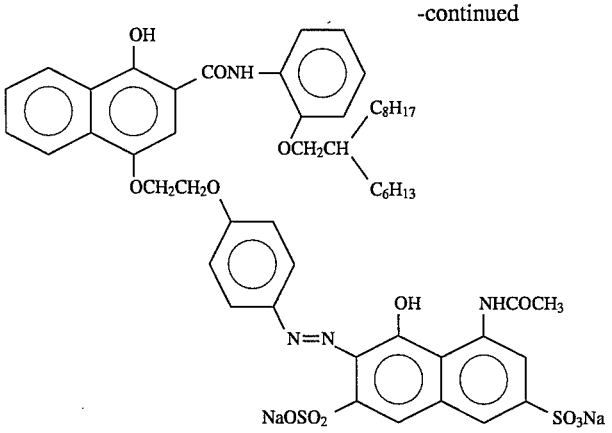
ExC-8
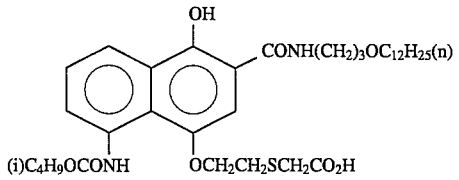
ExC-7
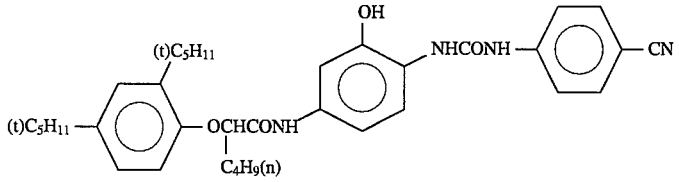
ExC-8
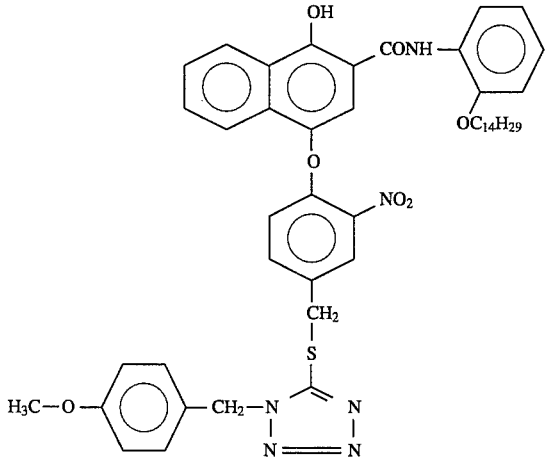
ExY-1
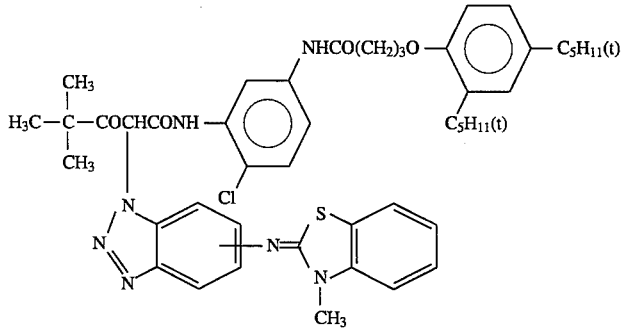

-continued
ExY-2
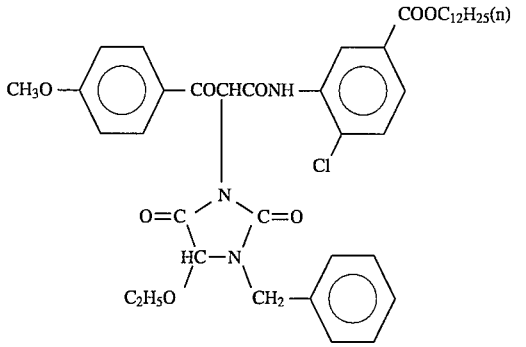
ExY-3
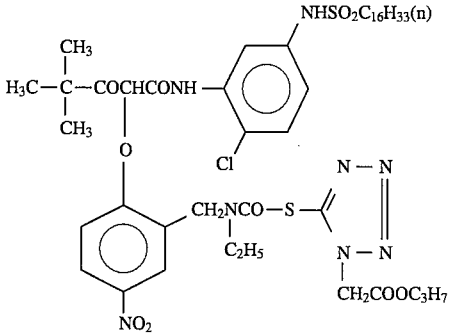
ExU-1
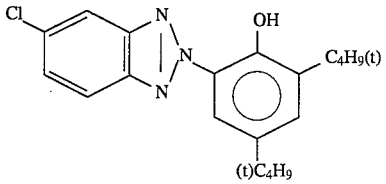
ExU-2
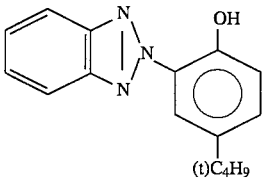
ExU-3
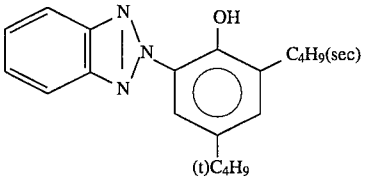
ExU-4
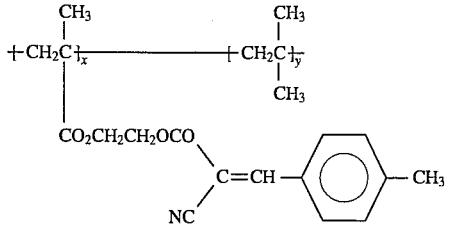
x:y = 70:30 (wt %)
ExU-5
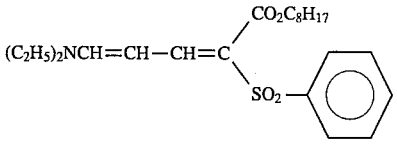

-continued
ExO-1
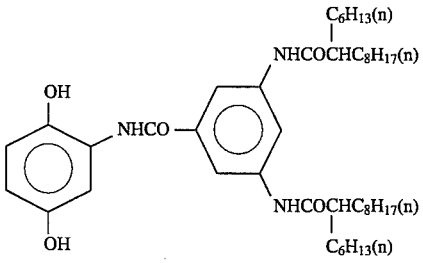
ExF-1
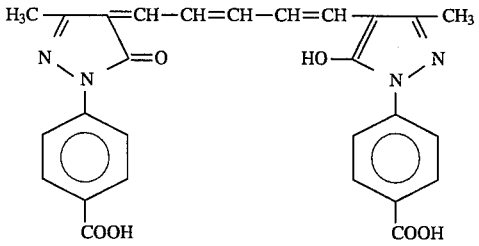
ExF-2
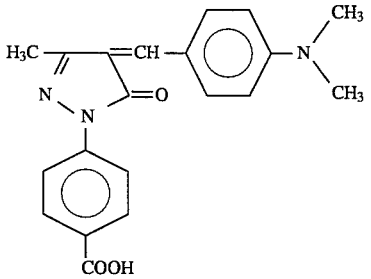
Tricresyl phosphate HBS-1
Di-n-butyl phthalate HBS-2
HBS-3
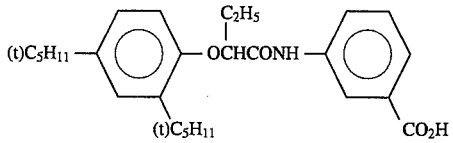
ExS-1
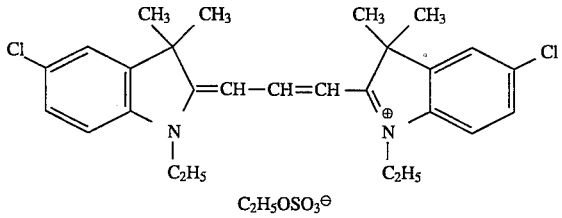
ExS-2
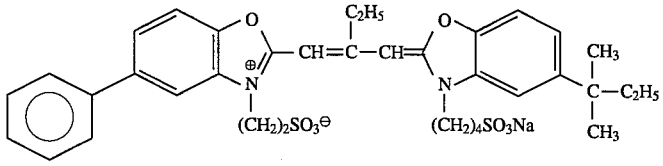
ExS-3
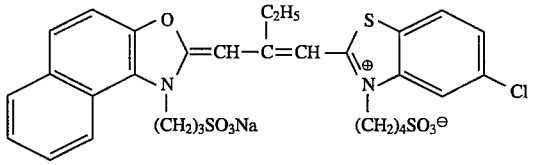

-continued
HBS-3
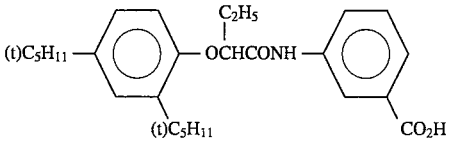
ExS-1
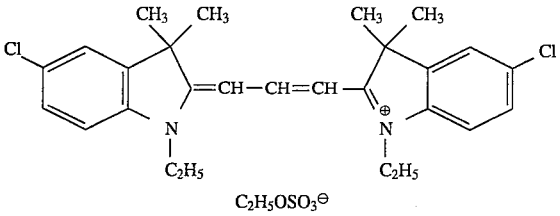
ExS-2
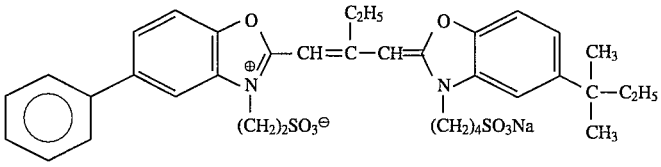
ExS-3
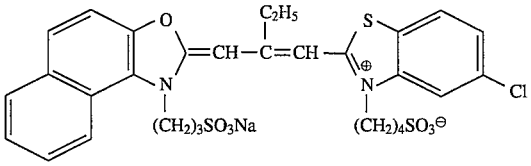
ExS-4
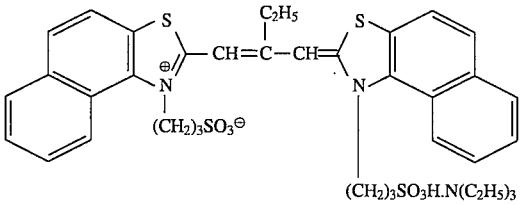
ExS-5
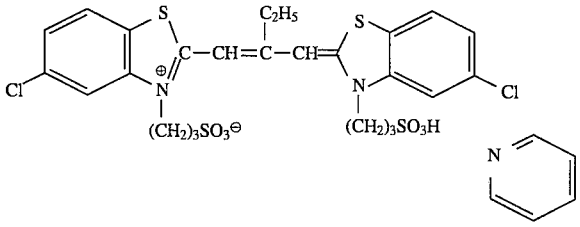
ExS-6
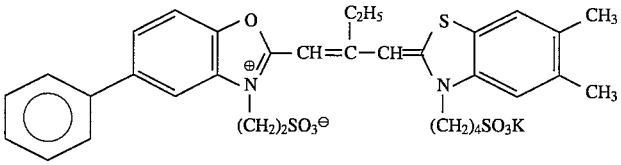
ExS-7
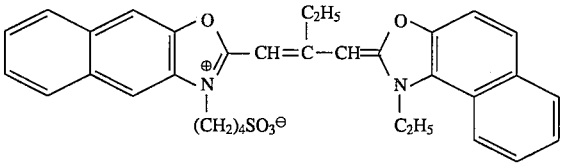
ExS-8
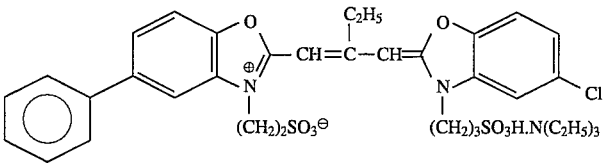

-continued
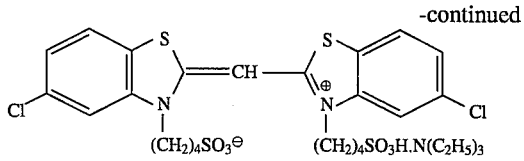
ExS-9
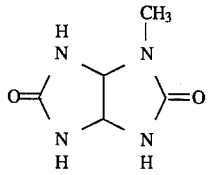
S-1
$CH_2{=}CH{-}SO_2{-}CH_2{-}CONH{-}CH_2$
$CH_2{=}CH{-}SO_2{-}CH_2{-}CONH{-}CH_2$
H-1
$C_8F_{17}SO_2NHCH_2CH_2CH_2OCH_2CH_2\overset{\oplus}{N}(CH_3)_3$
W-1
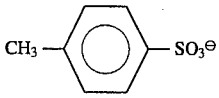
W-2
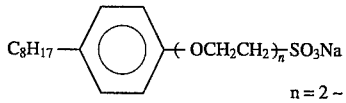
n = 2 ~ 4
W-3
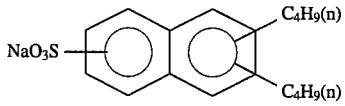
B-1
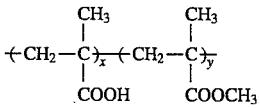
x/y = 10/90
B-2
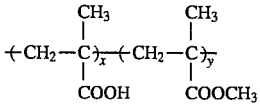
x/y = 40/60
B-3
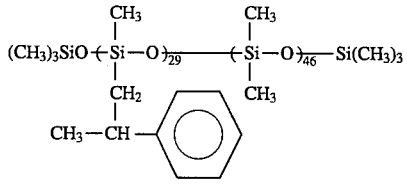
B-4
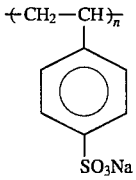
B-5
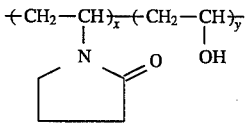
x/y = 70/30
B-6
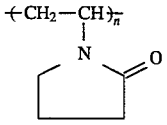
(mol. wt.: ca. 10,000)

-continued
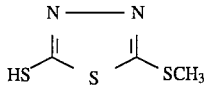
F-1
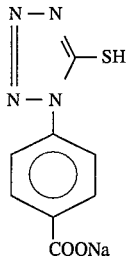
F-2
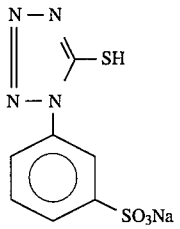
F-3
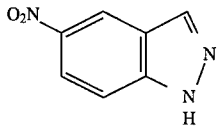
F-4
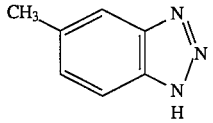
F-5
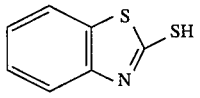
F-6
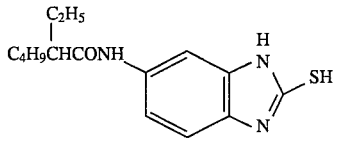
F-7
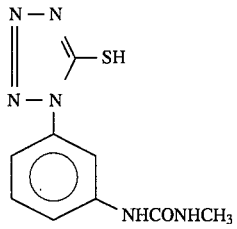
F-8
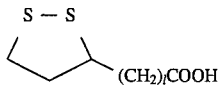
F-9
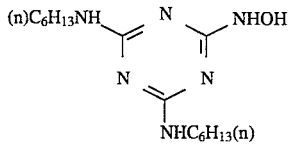
F-10

The thus prepared Samples were cut off into 35 mm width strips and each was given gradation exposure, and then was subjected to a running processing by an automatic processor. Each running processing was carried out continuously 50 meter length of 35 mm width sample.

Processing steps and compositions of processing solutions are shown below.

| Processing step | Processing time | Processing temperature | Replenisher* | Tank Volume |
|---|---|---|---|---|
| Color developing | 3 min 5 sec | 38.0° C. | 400 ml | 5 liter |
| Bleaching | 50 sec | 38.0° C. | 130 ml | 3 liter |
| Fixing (1) | 40 sec | 38.0° C. | - | 3 liter |
| Fixing (2) | 40 sec | 38.0° C. | 400 ml | 3 liter |
| Water washing | 30 sec | 38.0° C. | 440 ml | 2 liter |
| Stabilizing (1) | 20 sec | 38.0° C. | - | 2 liter |
| Stabilizing (2) | 20 sec | 38.0° C. | 400 ml | 2 liter |
| Drying | 60 sec | 55° C. | | |

Note:
*Replenisher amount per $m^2$ of photographic material.
Fixing and stabilizing were carried out in countercurrent mode from tank (2) to tank (1).

In the above processing, carried over amounts of developer to the bleaching step, bleaching solution to the fixing step, and fixing solution to the washing step were 65 ml, 50 ml, and 50 ml, per $m^2$ of the photographic material, respectively. Each cross-over time was 5 sec and is included in the processing time.

The composition of each processing solution was as follows, respectively:

| | Tank Solution (g) | Replenisher (g) |
|---|---|---|
| (Color-developer) | | |
| Diethylenetriaminetetraacetic acid | 2.0 | 2.2 |
| 1-Hydroxyethylidene-1,1-diphosphonic acid | 3.3 | 3.3 |
| Sodium sulfite | 3.9 | 5.2 |
| Potassium carbonate | 37.5 | 39.0 |
| Potassium bromide | 1.4 | — |
| Potassium iodide | 1.3 mg | — |
| Hydroxylamine sulfate | 2.4 | 3.8 |
| 2-Methyl-4-[ethyl-N-(β-hydroxyethyl)-amino]aniline sulfonate | 4.5 | 7.0 |
| Water to make | 1.0 liter | 1.0 liter |
| pH | 10.05 | 10.20 |
| (Bleaching solution) | | |
| Iron (III) ammonium 1,3-diaminopropane-tetraacetate monohydrate | 144.0 | 206.0 |
| Maleic acid | 40 | 60 |
| Succinic acid | 20 | 30 |
| Ammonium bromide | 84.0 | 120.0 |
| Ammonium nitrate | 17.5 | 25.0 |
| Hydroxyacetic acid | 63.0 | |
| Acetic acid | 54.2 | 80.0 |
| Water to make | 1.0 liter | 1.0 liter |
| pH | 4.40 | 4.00 |
| (pH was adjusted by aqueous ammonia) | | |

(Fixing solution)

-continued

| (Both tank solution and replenisher) | |
|---|---|
| Ammonium sulfite | 19.0 |
| Aqueous ammonium thisulfate solution (700 g/liter) | 280 ml |
| Additive | See Table 2 |
| Imidazole | 28.5 |
| Ethylenediaminetetraacetic acid | 12.5 |
| Water to make | 1.0 liter |
| pH | 7.40 |
| (pH was adjusted by aqueous ammonia and acetic acid) | |
| (Water washing solution) | |
| (Both tank solution and replenisher) | |
| Tap water was treated by passing through a mixed bed ion-exchange column filled with H-type strong acidic cation exchange resin (Amberlite IR-120B, tradename, made by Rohm & Haas) and OH-type strong basic anion exchange resin (Amberlite IRA-400, the same as the above) so that the concentrations of Ca ions and Mg ions decrease both to 3 ml/liter or below, followed by adding 20 mg/liter of sodium dichlorinated isocyanurate and 150 mg/liter of sodium sulfate. The pH of this water was in a range of 6.5 to 7.5. | |

| | (g) |
|---|---|
| (Stabilizing solution) | |
| (Both tank solution and replenisher) | |
| 1,4-bis(1,2,4-triazole-1-yl-methyl) piperazine | 0.6 |
| 1,2,4-Triazole | 1.3 |
| Polyoxyethylene-p-monononylphenyiether (av. polymerization degree: 10) | 0.2 |
| Disodium ethylenediaminetetraacetate | 0.05 |
| Sodium p-toluenesulfinate | 0.05 |
| 1,2-benzoisothiazoline-3-one | 0.05 |
| Gentamycin | 0.01 |
| Water to make | 1.0 liter |
| pH | 8.0 |

After finishing of the above each running processing, the unexposed Sample 101 was processed, and the residual silver was determined by a fluorescent X-ray analysis.

Further, each tank solution of fixing (1) after running processing was introduced into 200 ml polyethylene bottle, and stored 2 weeks at 10° C. and 0° C., respectively, and then presence or absence of precipitate was tested.

Criteria of evaluation of precipitate;

0: No precipitate was formed both after 10° C. and 0° C. storages,

1: Precipitates were formed slightly only after 0° C. storage,

2: Precipitates were formed slightly both after 10° C. and 0° C. storages,

3: Precipitates were formed in large amounts after 0° C. storage,

4: Precipitates were formed in large amounts both after 10° C. and 0° C. storages.

Further, 500 ml of each tank solution of fixing (1) after running processing was introduced into 500 ml tall beaker, and stored at 40° C. to examine days until the sulfur-deposit in the solution was occurred.

Results are shown in Table 2.

TABLE 2

| No. | Additive: Compound No. | Additive: Added amount (mol/l) | Residual silver (μg/cm²) | Formation of precipitate | Days till sulfur-deposit occurs | Remarks |
|---|---|---|---|---|---|---|
| 1 | — | — | 20 | 0 | 6 | Comparative Example |
| 2 | I-1 alone* | Equimolar** | 13 | 0 | over 30 | This Invention |
| 3 | I-1 | 0.01 | 16 | 0 | 7 | " |
| 4 | " | 0.05 | 8 | 0 | 8 | " |
| 5 | " | 0.1 | 3 | 0 | 12 | " |
| 6 | " | 0.5 | 1 | 0 | 15 | " |
| 7 | " | 1.0 | 1 | 0 | 15 | " |
| 8 | " | 2.0 | 1 | 0 | 15 | " |
| 9 | " | 3.0 | 1 | 1 | 15 | " |
| 10 | " | 4.0 | 1 | 3 | 15 | " |
| 11 | I-2 | 0.5 | 3 | 0 | 15 | " |
| 12 | I-3 | " | 2 | 0 | 14 | " |
| 13 | I-4 | " | 1 | 0 | 15 | " |
| 14 | I-6 | " | 2 | 0 | 13 | " |
| 15 | I-10 | " | 2 | 0 | 13 | " |
| 16 | I-12 | " | 1 | 0 | 15 | " |
| 17 | I-30 | " | 4 | 0 | 15 | " |
| 18 | I-32 | " | 5 | 0 | 15 | " |
| 19 | I-36 | " | 4 | 0 | 13 | " |
| 20 | I-37 | " | 4 | 0 | 13 | " |
| 21 | I-1 | 0.1 | 1 | 0 | over 30 | " |
| | II-1 | 0.4 | | | | |
| 22 | I-1 | 0.1 | 1 | 0 | over 30 | " |
| | II-14 | 0.4 | | | | |

Note;
*, **Compound I-1 was used in equimolar of ammonium thiosulfate instead of it.

As is apparent from the results of Table 2, the composition of the present invention containing the compound of formula (I) or (II) is superior to the composition containing ammonium thiosulfate in the fixing property, and the effect is exhibited remarkably in the combination use of the compound of formula (I) or (II) with ammonium thisulfate.

However, in the combination use with ammonium thiosulfate, if the amount of the compound of formula (I) to be added is too small, the effect is not exhibited enough, and if it is too large, precipitates are formed in the fixing solution, resulting being impossible to use practically. Therefore, the amount of compound of formula (I) to be added is preferably 0.05 to 2.0 mol/liter.

Further, when the compound represented by formula (I) was used in combination with the compound represented by formula (II), the fixing property and the stability of the fixing solution were improved.

EXAMPLE 2

With respect to Sample 102 that was prepared by changing emulsions in Example 1 to Emulsions L to P as shown below, the same results as Example 1 were obtained.

TABLE 3

| Emulsion in Example 1 | Emulsion changed | Coating amount of Ag (for the amount in Example 1) |
|---|---|---|
| Emulsion | Emulsion | |
| A | M | 100% |
| B | O | 70% |
| C | L | 50% |
| D | N | 50% |
| E | N | 70% |

TABLE 3-continued

| Emulsion in Example 1 | Emulsion changed | Coating amount of Ag (for the amount in Example 1) |
|---|---|---|
| F | Not changed | |
| G | L | 40% |
| H | P | 30% |
| I | Not changed | |
| J | L | 100% |
| K | P | 70% |

TABLE 4

| Emulsion No. | Average AgI content (mol %) | Average AgCl content (mol %) | Average grain diameter (μm) | Deviation coefficient concernig grain diameter (%) | Ratio of diameter/ thickness | Ratio of silver amount [Core/Med/Shell] (AgI content) | Grain structure |
|---|---|---|---|---|---|---|---|
| L | 6 | — | 0.80 | 18 | 7.5 | [1/4/1] (0/4/12) | I at outer, Triple structure grains |
| M | 4 | — | 0.45 | 15 | 6.0 | [1/1] (0/8) | I at outer, Triple structure grains |
| N | 6 | — | 0.95 | 15 | 7.8 | [1/3/1] (0/10/0) | I at inner, Triple structure grains |
| O | 6 | — | 0.50 | 18 | 5.5 | [1/3/1] (0/10/0) | 1 at inner, Triple structure grains |
| P | 6 | 8 | 1.20 | 20 | 7.8 | [1/3/1] (0/10/0) | 1 at inner, Triple structure grains (C1 is contained in shell) |

EXAMPLE 3

Sample 101 prepared in Example 1 was exposed to light, and then subjected to the processing by an automatic processor according to the following processing process and processing solutions (until the accumulated replenishment rate reached 3 times the tank volume).

| Processing step | Processing time | Processing temperature | Replenisher | Tank Volume |
|---|---|---|---|---|
| Color developing | 3 min 15 sec | 38° C. | 13 ml | 20 liter |
| Bleaching | 3 min | 38° C. | 25 ml | 40 liter |
| Water Washing (1) | 15 sec | 24° C. | 10 liter | |
| | Counter current piping mode from (2) to (1) | | | |
| Water washing (2) | 15 sec | 24° C. | 15 ml | 10 liter |
| Fixing | 3 min | 38° C. | 15 ml | 30 liter |
| Water washing (3) | 30 sec | 24° C. | | 10 liter |
| | Counter current piping mode from (4) to (3) | | | |
| Water washing (4) | 30 sec | 24° C. | 1,200 ml | 10 liter |
| Stabilizing | 30 sec | 38° C. | 20 ml | 10 liter |
| Drying | 4 min 20 sec | 55° C. | | |

Note:
*Replenisher amount per 1 m × 35 mm of photographic material.

The composition of each processing solution was as follows, respectively:

| | Tank solution (g) | Replenisher (g) |
|---|---|---|
| (Color-developer) | | |
| The same as Example 1 | | |
| (Bleaching solution) | | |
| Iron (III) ammonium 1,3-diaminopropane-tetraacetate monohydrate | 144.0 | 206.0 |
| Maleic acid | 40 | 60 |
| Succinic acid | 20 | 30 |
| Ammonium bromide | 84.0 | 120.0 |
| Ammonium nitrate | 17.5 | 25.0 |
| Hydroxyacetic acid | 63.0 | |
| Acetic acid | 54.2 | 80.0 |
| Water to make | 1.0 liter | 1.0 liter |
| pH (pH was adjusted by aqueous ammonia) | 4.40 | 4.00 |
| (Fixing solution) | | |
| Disodium ethylenediamine-tetraacetate | 0.5 | 0.57 |
| Ammonium sulfite | 20.0 | 22.7 |
| Aqueous ammonium thisulfate solution (700 g/liter) | 295.0 ml | 335.0 ml |
| Additive | See Table 5 | |
| Acetic acid (90%) | 3.3 | 3.7 |
| Water to make | 1.0 liter | 1.0 liter |
| pH (pH was adjusted by aqueous ammonia and acetic acid) | 6.7 | 6.8 |
| (Stabilizing solution) | | |
| The same as Example 1 | | |

After finishing of each running processing described above, the evaluation of residual silver was conducted in the same manner as Example 1 (referred to as Condition A).

The same test was carried out, except that ammonium sulfite, ammonium thiosulfite, and aqueous ammonia in the fixing solution were changed to each equimolar amount of sodium sulfite, sodium thiosulfate, and sodium hydroxide (referred to as Condition B).

Results are shown in Table 5.

TABLE 5

| No. | Condition | Additive Compound | Additive Amount added (mol/l) | Residual silver ($\mu g/cm^2$) | Remarks |
|---|---|---|---|---|---|
| 1 | A | — | — | 20 | Comparative Example |
| 2 | A | I-1 | 0.5 | 2 | This Invention |
| 3 | B | — | — | 100 | Comparative Example |
| 4 | " | I-1 | 0.5 | 2 | This Invention |
| 5 | " | I-2 | " | 2 | " |
| 6 | " | I-4 | " | 3 | " |
| 7 | " | I-5 | " | 3 | " |
| 8 | " | I-6 | " | 3 | " |
| 9 | " | I-7 | " | 3 | " |
| 10 | " | I-11 | " | 2 | " |
| 11 | " | I-12 | " | 2 | " |
| 12 | " | I-1 | 0.5 | 1 | " |
| | | II-1 | 0.1 | | |
| 13 | " | I-5 | 0.5 | 1 | " |
| | | II-5 | 0.1 | | |
| 14 | " | I-1 | 0.5 | 1 | " |
| | | II-18 | 0.1 | | |
| 15 | " | I-1 | 0.5 | 1 | " |
| | | II-30 | 0.1 | | |
| 16 | " | I-4 | 0.5 | 2 | " |
| | | II-40 | 0.1 | | |

As is usually known, sodium thiosulfite is inferior to ammonium thiosulfate in the fixing property.

As is apparent from the results in Table 5, in the composition of this invention the compound of formula (I) or (II) not only improves the fixing property in a combination use with ammonium thiosalfate, but also can exhibit its effect remarkably in combination use with sodium thiosulfate.

In particular, in view of environmental preservation in recent years, since removing of ammonium from the processing waste solution is desired, the compound of the present invention can dissolve this problem.

EXAMPLE 4

Silver iodobromide (bromine content: 30 mol %, iodine content: 0.1 mol %) emulsion was obtained by precipitating silver halide grains using a double-jet process, physical ripening, and chemical ripening after desilvering treatment. The average diameter of silver halide grains contained in this emulsion was 0.3 μm. In one kilogram of this emulsion 0.6 mol of silver halide was contained. Each 1 kg of this emulsion was weighed out, and, after dissolving by heating at 40° C., a methanol solution of a sensitizing dye an aqueous solution of sodium bromide were added each, in a prescribed amount.

Next, 25 ml of 1 wt. % methanol solution of dye, 30 ml of 1.0 wt. % aqueous solution of sodium 1-hydroxy-3,5-dichlorotriazine, and 40 ml of 1.0 wt. % aqueous solution of sodium dodecylbenzenesulfonate were added successively, and stirred. A photographic material sample was obtained by coating and drying this completed emulsion on a triacetate cellulose film so that the thickness of dried coating film would be 5 μm.

These samples were cut off and subjected to a blackening exposure by a sensitometer having a light source of color temperature 2666K. Then, a running processing according to the processing steps shown below, until the accumulated replenisher of the fixing solution had reached 3 times volume of mother solution tank.

| Processing step | Processing time | Processing temperature | Replenisher* | Tank Volume |
|---|---|---|---|---|
| Developing | 20 sec | 38° C. | 320 ml | 18 liter |
| Fixing | 20 sec | 38° C. | 220 ml | 18 liter |
| Water washing | 20 sec | 20° C. | 200 ml | 18 liter |

(Developer)
(Both tank solution and replenisher)

| | |
|---|---|
| Metole | 0.31 g |
| Anhydrous sodium sulfite | 39.6 g |
| Hydroquinone | 6.0 g |
| Anhydrous sodium carbonate | 18.7 g |
| Potassium bromide | 0.86 g |
| Citric acid | 0.68 g |
| Potassium metabisulfite | 1.5 g |
| Water to make | 1 liter |

(Fixing solution)
(Both tank solution and replenisher)

| | |
|---|---|
| Sodium thiosulfate | 200 g |
| Additive | See Table 6 |
| Sodium hydrogensulfite | 12.0 g |
| Disodium ethylenediaminetetraacetate | 0.1 g |
| Tartaric acid | 3.0 g |
| Acetic acid (90%) | 20.0 g |
| Aluminum sulfate (27%) | 35.0 g |
| Water to make | 1 liter |
| pH (adjusted by adding NaOH) | 4.1 |

Note:
*Replenisher amount per $m^2$ of photographic material.

After finishing each described above, samples processed were determined the residual silver at the unexposed part by a fluorescent X-rays analysis.

Results are shown in Table 6.

TABLE 6

| No. | Additive Compound | Additive Amount added (mol/l) | Residual silver ($\mu g/cm^2$) | Remarks |
|---|---|---|---|---|
| 1 | — | — | 8.3 | Comparative Example |
| 2 | I-1 | 0.5 | 0.9 | This Invention |
| 3 | I-2 | " | 0.9 | " |
| 4 | I-3 | " | 0.9 | " |
| 5 | I-5 | " | 1.0 | " |
| 6 | I-8 | " | 1.1 | " |
| 7 | I-9 | " | 1.1 | " |
| 8 | I-11 | " | 1.2 | " |
| 9 | I-14 | " | 1,0 | " |
| 10 | I-18 | " | 1.0 | " |
| 11 | I-22 | " | 1,1 | " |
| 12 | I-23 | " | 1.3 | " |
| 13 | I-29 | " | 1.2 | " |
| 14 | I-33 | " | 1.5 | " |
| 15 | I-34 | " | 1.4 | " |
| 16 | I-38 | " | 1.5 | " |
| 17 | I-44 | " | 1.2 | " |
| 18 | I-1 | 0.5 | 0.5 | " |
| | II-1 | 0.3 | | |

As is apparent from the results in Table 6, when the composition of the present invention containing the compound of formula (I) or (II) is used, the fixing capacity is improved remarkably.

EXAMPLE 5

A color printing paper same as described in Example 1 of JP-A No. 313281/1993 was converted to a roll having 127 mm width, and the roll was subjected to an imagewise exposure and a continuous processing (running test) according to the processing step shown below until the replenisher volume had reached to twice the tank volume, using Printer Processor PP1250V, made by Fuji Photo Film Co., Ltd. (the processor was demodelled so that the bleach-fix processing time was to be 25 sec).

| Processing step | Temperature | Time | Replenisher* |
|---|---|---|---|
| Color developing | 38.5° C. | 45 sec | 73 ml |
| Bleach-fix | 35° C. | 25 sec | 60 ml** |
| Rinse (1) | 35° C. | 30 sec | — |
| Rinse (2) | 35° C. | 30 sec | — |
| Rinse (3) | 35° C. | 30 sec | 360 ml |
| Drying | 80° C. | 60 sec | |

Note:
*Replenisher amount per $m^2$ of photographic material.
**In addition to 60 ml described above, 120 ml per $m^2$ of photographic material of Rinse (1) solution was flowed into the bleach-fix bath. Rinsing steps were carried out in 3-tanks countercurrent mode from the tank of rinsing (3) toward the tank of rinsing (1).

Composition of each processing solution was as follows:

| | Tank Solution | Replenisher |
|---|---|---|
| (Color-developer) | | |
| Water | 800 ml | 800 ml |
| Ethylenetriaminetetraacetic acid | 3.0 g | 3.0 g |
| Disodium 4,5-dihydroxybenzene-1,3-disulphonic acid | 0.5 g | 0.5 g |
| Triethanolamine | 12.0 g | 12.0 g |
| Pottasium chloride | 6.5 g | — |
| Potassium bromide | 0.03 g | — |
| Potassium carbonate | 27.5 g | 27.0 g |
| Fluorescent brightening agent, (WHITEX 4, made by Sumitomo Chemical. Co.) | 1.0 g | 3.0 g |
| Disodium-N,N-bis(sulfonatoethyl) hydroxylamine | 5.0 g | 10.0 g |
| Sodium triisopropylnaphthalene(β) sulfonate | 0.1 g | 0.1 g |
| N-Ethyl-N-(β-methanesulfonamido-ethyl)-3-methyl-4-aminoaniline 3/2-sulfonate monohydrate | 5.0 g | 11.5 g |
| Water to make | 1,000 ml | 1,000 ml |
| pH | 10.00 | 11.00 |
| (pH was adjusted by potassium hydroxide and NAOH at 25° C.) | | |
| (Bleach-fix solution) | | |
| Water | 600 ml | 600 ml |
| Sodium thiosulfate | 47 g | 120 g |
| Sodium sulfite | 20 g | 50 g |
| Iron (III) sodium ethyleneqiamine tetraacetate | 55 g | 135 g |
| Ethylenediaminetetraacetic acid | 5 g | 12.5 g |
| Nitric acid (67%) | 30 g | 65 g |
| Water to make | 1,000 ml | 1,000 ml |
| pH | 5.8 | 5.6 |
| (pH was adjusted by acetic acid and NaOH at 25° C.) | | |
| (Rinse solution) | | |
| (Both tank solution and replenisher) | | |
| Sodium chlorinated cyanurate | 0.02 g | |
| Deionized water (conductivity: 5 μs/cm or below) | 1,000 ml | |
| pH | 6.5 | |

After the running test described above, the unexposed color printing paper described above was processed, and the residual silver was determined to find that it was 15 $\mu g/cm^2$.

In the same test as described above, compounds I-2 and II-2 of the present invention were added into the tank solution of bleach-fix and the replenisher, each in an amount of 0.25 mol/liter, and the residual silver in the printing paper after the same running test as the above was determined to find that it was 2 $\mu g/cm^2$. Thus, the fixing property was remarkably improved by adding the compounds of the present invention.

EXAMPLE 6

Sample 201 was prepared in the same manner as in Example 1, except that as the support polyethylene terephthalate film having a thickness of 100 μm was used instead of undercoated triacetate cellulose film support of Sample 101 in Example 1, and a stripe magnetic recording layer as described in Example 1 of JP-A No. 124628/1992 was coated on the backside of the support. When the same test as in Example 1 was carried out by using this Sample 201, the similar effects to Example 1 were obtained.

Further, Sample 202 was prepared in the same manner as in Example 1, except that the same support and back layer as Sample Nos. 1 to 3 in Example 1 of JP-A No. 62453/1992 was used instead of support for Sample 1 of Example 1, and $C_8F_{17}SO_2N(C_3H_7)CH_2COOK$ was coated in the second protective layer in a coating amount of 5 $mg/m^2$. This Sample 202 was converted to format shown in FIG. 5 of JP-A No. 62543/1992, the same test as Example 1 was carried out to obtain the same effect of the present invention as in Example 1.

EXAMPLE 7

After finishing of No. 21 running processing in Example 1, when negative films described below was processed, results were good without causing contamination.

Reala (Tradename) Lot No. 87004, made by Fuji Photo Film Co., Ltd.

Super G100 S06214 (Tradename), made by Fuji Photo Film Co., Ltd.

Super G400 V06254 (Tradename), made by Fuji Photo Film Co., Ltd.

Utsurundesu800 M02-508 (Tradename), made by Fuji Photo Film Co., Ltd.

SuperHG1600 761004 (Tradename), made by Fuji Photo Film Co., Ltd.

FUJICOLOR 160S 084016 (Tradename), made by Fuji Photo Film Co., Ltd.

Having described our invention as related to the present embodiments, it is our intention that the invention not be limited by any of the details of the description, unless otherwise specified, but rather be construed broadly within its spirit and scope as set out in the accompanying claims.

What we claim is:

1. A silver halide photographic fixing composition, which comprises water and at least one compound represented by the following formula (I):

$$RSO_2SM \qquad \text{formula (I)}$$

wherein R represents an aliphatic group, an aromatic group, or a heterocyclic group, and M represents a hydrogen atom or a cationic group, wherein the compound of formula (I) is contained in the composition in a concentration of from $1\times10^{-3}$ mol/l to 5 mol/l.

2. The photographic composition as claimed in claim 1, wherein R in formula (I) is selected from the group consisting of a straight-chain, branched-chain, or cyclic alkyl group, alkenyl group, alkynyl group, aralkyl group having 1 to 30 carbon atoms, aryl group having 6 to 30 carbon atoms, and a 3- to 10-membered saturated or unsaturated heterocyclic group having at least one of N, O, and S.

3. The photographic composition as claimed in claim 1, wherein M in formula (I) is selected from the group consisting of a hydrogen atom, an alkali metal ion, an alkali earth metal ion, an ammonium group, and a guanidinium group.

4. The photographic composition as claimed in claim 1, wherein R in formula (I) represents an aliphatic group having 1 to 6 carbon atoms, and M in formula (I) represents a sodium ion, a potassium ion, or an unsubstituted ammonium group.

5. The photographic composition as claimed in claim 1, which further comprises at least one compound represented by the following formula (II):

$$R^1SO_2M^1 \qquad \text{formula (II)}$$

wherein $R^1$ represents an aliphatic group, an aromatic group, or a heterocyclic group, and $M^1$ represents a hydrogen atom or a cationic group.

6. The photographic composition as claimed in claim 5, wherein $R^1$ in formula (II) is selected from the group consisting of a straight-chain, branched-chain, or cyclic alkyl group, alkenyl group, alkynyl group, aralkyl group having 1 to 30 carbon atoms, aryl group having 6 to 30 carbon atoms, and a 3- to 10-membered saturated or unsaturated heterocyclic group having at least one of N, O, and S.

7. The photographic composition as claimed in claim 5, wherein $M^1$ in formula (II) is selected from the group consisting of a hydrogen atom, an alkali metal ion, an alkali earth metal ion, an ammonium group, and a guanidinium group.

8. The photographic composition as claimed in claim 5, wherein $R^1$ in formula (II) represents an aliphatic group having 1 to 6 carbon atoms or an aromatic group having 6 to 12 carbon atoms, and $M^1$ in formula (II) represents a sodium ion, a potassium ion, or an unsubstituted ammonium group.

9. The photographic composition as claimed in claim 5, wherein concentration of the compound of formula (I) and the compound of formula (II) is $1\times10^{-3}$ mol per liter or more.

10. The photographic composition as claimed in claim 1, wherein said compound of formula (I) is contained in an aqueous solution.

11. The photographic composition as claimed in claim 1, wherein R represents an unsubstituted aliphatic group, an unsubstituted aromatic group, or an unsubstituted heterocyclic group.

12. The photographic composition as claimed in claim 1, wherein the concentration of the compound of formula (I) in the composition is $1\times10^{-2}$ to 2 mol per liter of said composition.

13. The photographic composition as claimed in claim 1, which further comprises at least one compound selected from the group consisting of a thiosulfate, a thiocyanate, a thiourea compound, a thioether compound, a mercapto compound, and a metho-ionic compound.

14. The photographic composition as claimed in claim 13, wherein said composition contains a thiosulfate.

15. The photographic composition as claimed in claim 14, wherein said thiosulfate is sodium thiosulfate or ammonium thiosulfate.

16. The photographic composition as claimed in claim 14, wherein the concentration of the compound of formula (I) is 0.05 to 2.0 mol per liter of composition.

* * * * *